US007568311B2

(12) United States Patent
Shivak et al.

(10) Patent No.: US 7,568,311 B2
(45) Date of Patent: Aug. 4, 2009

(54) SLIDING DOOR ARRANGEMENT

(75) Inventors: Vincent A. Shivak, Calgary (CA); Rupert Jakob-Bamberg, Calgary (CA); Robert E. Steeves, Calgary (CA)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 11/450,908

(22) Filed: Jun. 9, 2006

(65) Prior Publication Data

US 2007/0283640 A1 Dec. 13, 2007

(51) Int. Cl.
*E05D 15/16* (2006.01)
*E06B 1/04* (2006.01)

(52) U.S. Cl. ..... 49/409; 49/425; 52/207

(58) Field of Classification Search ..... 52/207, 52/243.1, 204.51; 49/409, 410, 411, 425, 49/504, 372

See application file for complete search history.

(56) References Cited

U.S. PATENT DOCUMENTS 4,099,599 A * 7/1978 Randall ..... 187/313
4,276,919 A * 7/1981 Walters ..... 160/206
4,561,210 A * 12/1985 Kvas et al. ..... 49/372
4,639,970 A * 2/1987 Adams ..... 16/90
4,656,781 A * 4/1987 Niekrasz et al. ..... 49/404
4,891,921 A * 1/1990 Governale ..... 52/207
5,070,575 A * 12/1991 Redman et al. ..... 16/96 R
5,349,783 A * 9/1994 Jasperson et al. ..... 49/425
5,461,829 A * 10/1995 Lehto et al. ..... 49/409
5,845,363 A * 12/1998 Brempell et al. ..... 16/105
6,233,888 B1 * 5/2001 Wu ..... 52/207
6,289,643 B1 * 9/2001 Bonar ..... 52/207
6,532,699 B1 * 3/2003 Franklin et al. ..... 52/29
6,698,138 B1 * 3/2004 Lin ..... 49/409
2006/0185250 A1 * 8/2006 Gosling et al. ..... 49/409
2007/0062121 A1 * 3/2007 Tarrega Illoret ..... 49/409
2008/0148643 A1 * 6/2008 Lemming ..... 49/409

* cited by examiner

*Primary Examiner*—Gay Ann Spahn
(74) *Attorney, Agent, or Firm*—Flynn, Thiel, Boutell & Tanis, P.C.

(57) ABSTRACT

A sliding glass door has a pair of rollers mounted adjacent the upper corners, which rollers are cantilevered rearwardly and cooperate with a horizontally elongate L-shaped support track which spans horizontally across the door opening and across an adjacent upright wall panel to enable the door to move into an opened position wherein it overlies the adjacent wall panel. The height of the roller-track arrangement and of the structure defining such arrangement, as it extends across the upper edge of the door opening and the adjacent wall panel, is minimized to provide improved aesthetics.

26 Claims, 18 Drawing Sheets

28

SLIDING DOOR ARRANGEMENT

FIELD OF THE INVENTION

This invention relates to a sliding door arrangement and, more specifically, relates to an improved roller-track arrangement which cooperates with an upper edge of a glass sliding door for maintaining the door in a suspended position while permitted movement of the door between opened and closed positions.

BACKGROUND OF THE INVENTION

Sliding doors which are dominantly of glass and are downwardly suspended from a roller-track arrangement which couples the door to the adjacent wall or ceiling are currently used in association with walls for dividing interior office spaces and the like, and there is increased demand for such sliding glass doors for use in conjunction with upright walls defined by a plurality of generally prefabricated wall panels which are dominantly of glass and are horizontally serially joined. The sliding glass door is typically supported from the wall so as to be positioned laterally adjacent one exterior side face of the wall, and the door is horizontally slidable in this laterally displaced position between an open position wherein the door overlaps the side face of the wall adjacent one side of a door opening, and a closed position wherein the door overlaps and hence closes off the door opening. Because of the weight of the glass door and the visibility associated with both the door and the adjacent glass wall panels, and the irregular or non-level configuration of the floor in the vicinity of the wall, the door is preferably supported by a roller-track arrangement which cooperates with the upper edge of the door and couples to the adjacent wall, so that the sliding glass door is suspended from the upper edge thereof and maintained in a lateral position adjacent the side face of the wall. The roller-track arrangement, however, must be able to not only maintain the significant weight of the door when in its opened and closed positions and in any intermediate location therebetween, but also maintain the desired horizontal alignment of the door relative to adjacent wall panels when in both the opened and closed positions.

While numerous sliding glass doors of the aforementioned type have been developed for use in this environment, nevertheless one of the problems associated with such doors has been the size and undesired aesthetics associated with the roller-track arrangement, which size and appearance are readily noticeable and hence have a significant impact on the overall aesthetics of the wall in view of the dominant glass construction of both the wall panels and the door. In addition, many of the known sliding glass doors have not permitted easy positional adjustment of the door relative to the adjacent wall panels so as to provide desired alignment and aesthetics.

In many known sliding glass doors, a typical construction for the roller-track arrangement involves a horizontally elongate track member defined by a generally flat metal plate having a width which substantially exceeds its thickness, and the cross-section of the plate is oriented so that the width of the track member is oriented vertically so as to optimize the strength of the plate due to the loads imposed thereon by the door. The rollers are typically disposed in their entirety above the track so as to be rollingly engaged with an upper edge of the track, the roller typically having protruding side flanges for overlapping the opposite sides of the track to sidewardly confine the roller on the track. While this arrangement is conventional and does provide a proper rolling support and engagement between the rollers and track, nevertheless the overall combination of the track and rollers and their individual sizes and vertical disposition one above the other cause the overall roller-track arrangement to be of significant height. Further, this roller-track arrangement is typically positioned within a downwardly-opening channel-shaped confinement member which also must be of significant vertical height in order to confine both the rollers and the track therein. As a result, the overall roller-track arrangement is significantly cumbersome, particularly with respect to its overall vertical height, and this greatly detracts from the desired overall appearance and aesthetics of the door-wall arrangement, particularly since visibility of the roller-track arrangement is effectively accentuated by the overall glass construction of both the door and the adjacent wall panels.

In addition, known roller-track arrangements, such as arrangements of the type discussed above, have typically coupled the track to the adjacent wall by support brackets which typically are designed to provide limited vertical adjustment of the track. With this type of vertical adjustment capability, however, the manual manipulation required to effect vertical adjustment is typically difficult to carry out. Further, and more significantly, such adjustment results in simultaneous adjustment of both the track and roller, and does not permit vertical adjustment of the roller independently of the track.

Accordingly, it is an object of this invention to provide an improved sliding glass door arrangement for use in conjunction with a door opening formed in an interior upright wall which is preferably defined primarily by upright wall panels which are also dominantly of glass, including an improved roller-track arrangement which provides improved cooperative and aesthetic relationships with respect to suspension of the sliding glass door adjacent one lateral side of the upright wall, and which overcomes many of the disadvantages associated with prior constructions of this general type as briefly discussed above.

More specifically, with the present invention, the sliding glass door has a pair of rollers mounted adjacent the upper corners thereof, which rollers are cantilevered rearwardly and cooperate with a horizontally elongate support track which spans horizontally across the upper edge of the door opening and also extends horizontally across an adjacent upright wall panel to enable the door to be moved into an opened position wherein it is disposed in laterally overlying relationship to the adjacent wall panel. The track is defined by a horizontally elongate rail member having an upright leg which overlies and is rigidly joined to a top load-bearing frame arrangement which extends across the top of the door opening. The rail member also has a support leg which is horizontally cantilevered outwardly and defines thereon a horizontal lengthwise-extending guide track, preferably an upwardly-opening guide groove, which cooperates with the rollers to provide sideward confinement of the rollers while allowing them to be rollingly displaced lengthwise of the rail member. The rollers are mounted on bracket structures which secure to the door adjacent the upper edge thereof, whereby the rollers are disposed adjacent the rear side of the door and disposed above the horizontal leg of the rail and do not protrude significantly above the rail member. The overall height of the roller-track arrangement and of the structure defining such arrangement, as it extends across the upper edge of the door opening and the adjacent wall panel, is minimized so as to provide significantly improved aesthetics.

It is also an object of the invention to provide an improved roller-track arrangement for a sliding glass door, as aforesaid, which cooperates with a generally inverted U-shaped frame which defines the door opening, a top header of the door frame being rigidly joined to the rail member for supporting the loads thereof, which loads are transmitted downwardly along vertical side legs of the door frame for efficient transfer to the floor, thereby minimizing structural connection and/or transfer of loads either to the adjacent wall panels or to the ceiling.

In the improved roller-track arrangement of this invention, as aforesaid, the bracket which couples the individual rollers to the door also have capability of permitting vertical adjustment of the upper edge of the door relative to the roller, which adjustment can be easily and efficiently carried out in a manner which is wholly independent of the mounting of the track to the associated support frame. The improved roller-track arrangement, as aforesaid, is also believed to provide improved durability, particularly with respect to impact loads which are typically imposed on the door during opening and closing thereof, and additionally includes structural and functional relationships which are believed to provide significantly improved characteristics with respect to its overall structure, performance and aesthetics, as described in greater detail hereinafter.

Other objects and purposes of the invention will be apparent to persons familiar with constructions of this general type upon reading the following specification and inspecting the accompanying drawings.

Figure 1:
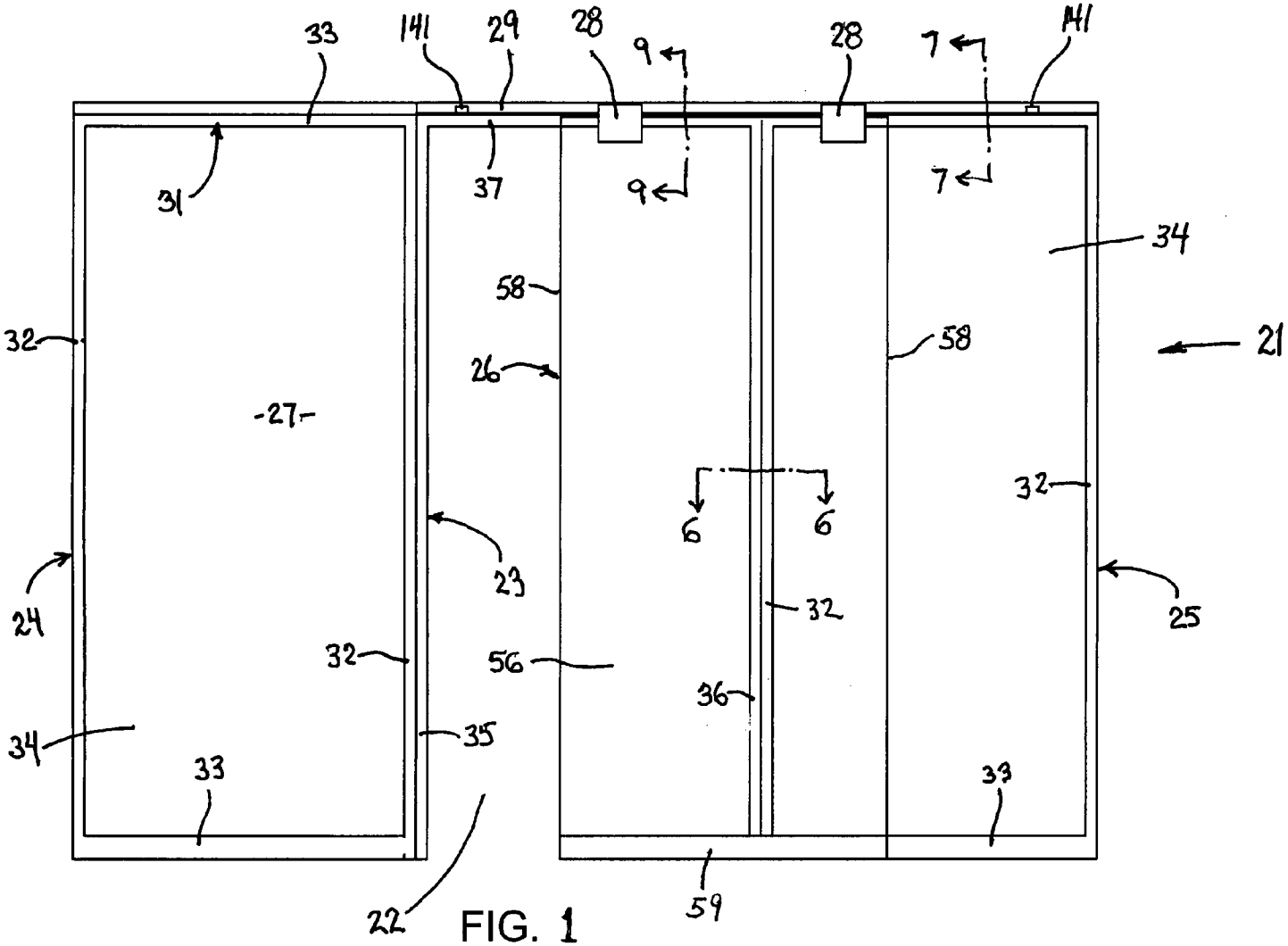
FIG. 1 is a side elevational view of an upright wall construction employing a pair of upright wall panels joined by a doorway arrangement employing a sliding door.
Figure 2:
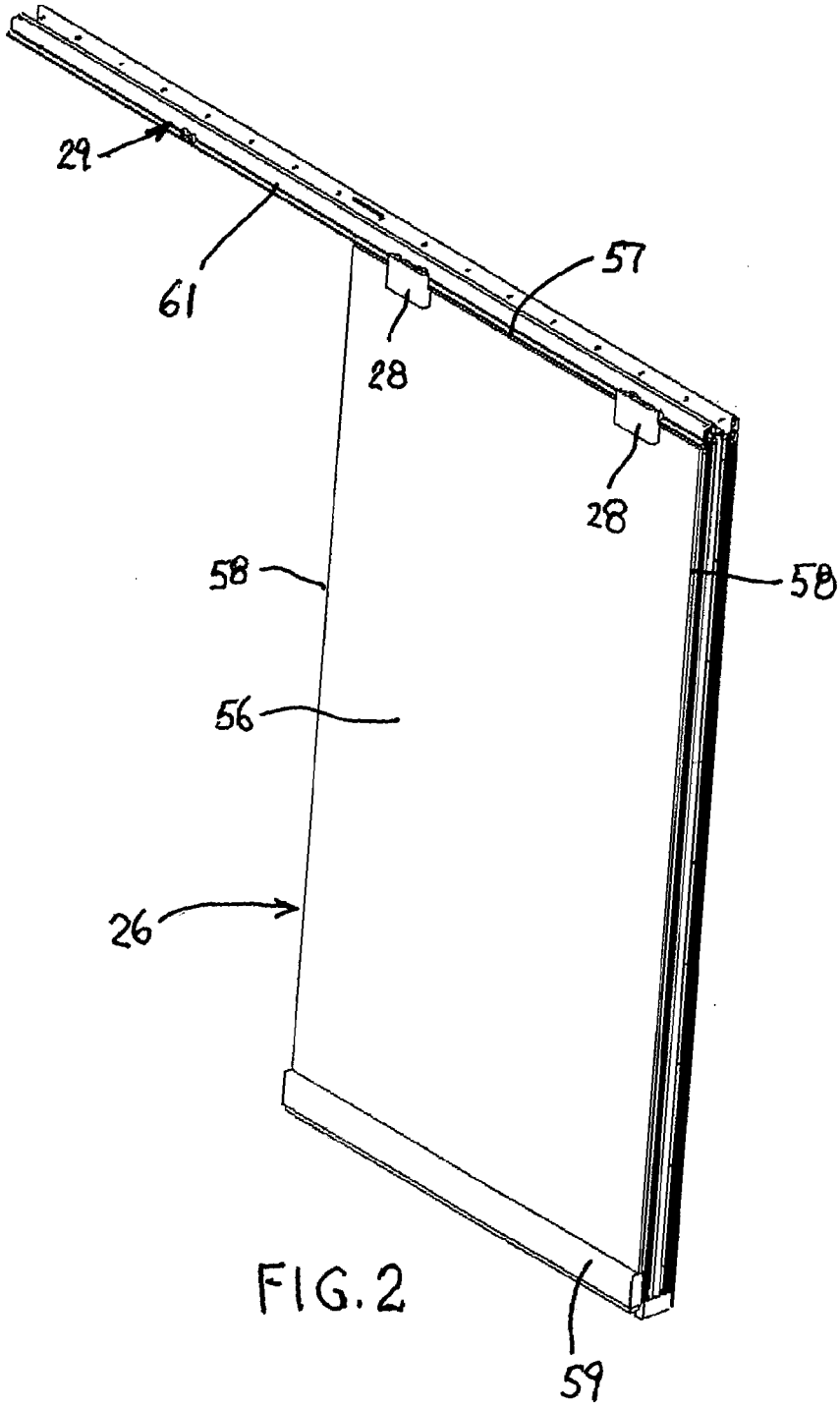
FIG. 2 is a perspective view of solely the sliding door and is associated with an overhead support rail or track.
Figure 5:
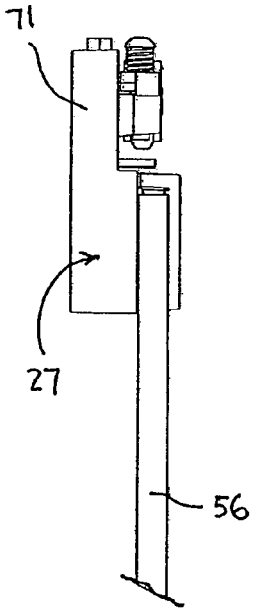
FIG. 5 is a fragmentary enlarged view of the upper portion of the door, namely the portion illustrated within the circle shown in FIG. 4.
Figure 4:
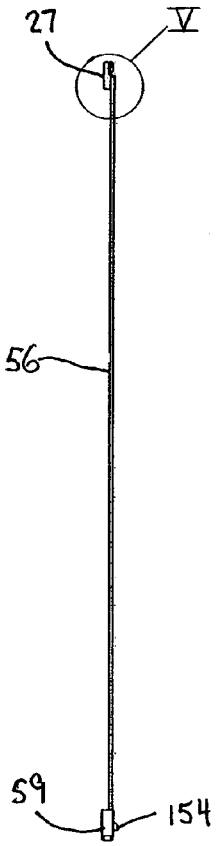
FIG. 4 is an end elevational view taken from the left side of the door as shown in FIG. 3.
Figure 3:
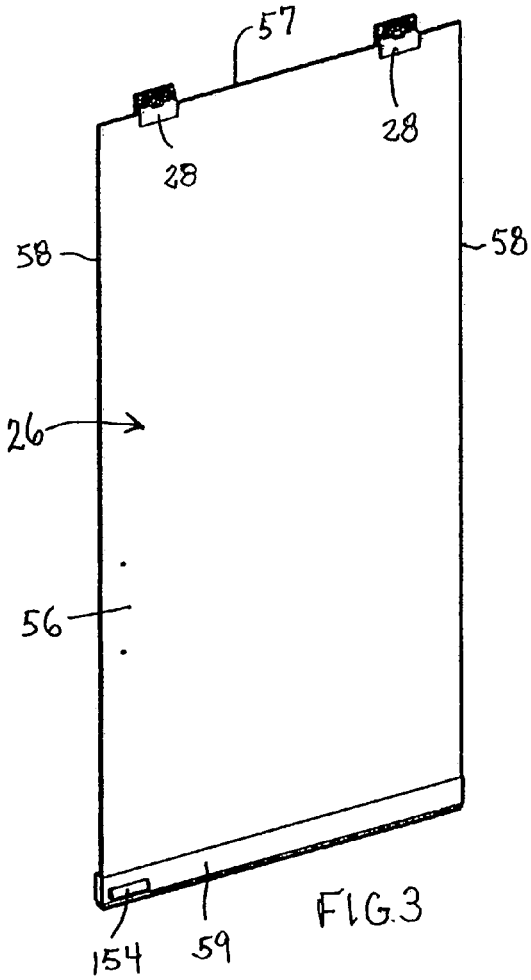
FIG. 3 is a perspective view of solely the sliding door as viewed from the inner or back side thereof, namely the side which overlaps an adjacent wall panel when the door is in an open position.

Certain terminology will be used in the following description for convenience and reference only, and will not be limiting. For example, the words "upwardly," "downwardly," "rightwardly," and "leftwardly" will refer to directions in the drawings to which reference is made. The words "upwardly" and "downwardly" will also be used in their conventional sense to indicate the orientation of the wall structure and door assembly relative to the floor and ceiling with which they are associated. The words "front" or "outer" will be used to reference the exposed side of the door which is always visible, irrespective of whether the door is in its open or closed position, and the words "back" or "inner" will be used to refer to the side of the door assembly which directly confronts and overlaps the wall when the door is in an opened position. The words "inwardly" and "outwardly" will refer to directions toward and away from, respectively, the geometric center of any referenced assembly or any referenced part thereof. Said terminology will include the words specifically mentioned, derivatives thereof, and words of similar import.

DETAILED DESCRIPTION

Referring to FIG. 1, there is illustrated an upright wall arrangement 21 which is typically intended for support on a floor within a building, and which cooperates with additional fixed or prefabricated moveable walls to assist in dividing a large open area into smaller areas used for offices and the like. The upright wall 21 in the illustrated arrangement has a doorway 22 associated therewith for permitting passage between adjacent areas, such as between a hallway and an adjacent office. The doorway or passage 22 is in the present invention defined by an inverted U-shaped door frame 23 which is disposed in sidewardly aligned relationship with, and joined to, a pair of sidewardly adjacent upright wall panels 24 and 25. The upright wall 21 has a vertically suspended sliding door 26 associated therewith. The sliding door 26 is disposed in laterally adjacent and generally overlapping relationship to one exposed side 27, herein referred to as the front side, of the upright wall. The sliding door 26 is horizontally moveable in the elongated direction of the wall between a closed position wherein the door wholly overlaps and closes off the doorway 22, and an open position wherein a significant majority of the door sidewardly overlaps one of the sidewardly adjacent wall panels, namely the wall panel 25 in the arrangement illustrated by FIG. 1. This latter door panel 25, which is overlapped by the door when the latter is in an open position, is typically referred to as a side light. The door 26 in the arrangement illustrated in FIG. 1 is shown in a partially open position.

The suspended sliding door 26 has roller hanger units 28 mounted adjacent the upper edge thereof, in the vicinity of the opposite upper corners of the door. The pair of roller hanger units 28 as mounted on the upper edge of the door are typically substantially identical except for being right and left units (i.e. mirror images of one another). The roller hanger units 28 cooperate with a horizontally elongate track or rail arrangement 29 which is mounted on and extends horizontally along the upper edge of both the door frame 23 and the adjacent side light panel 25, as described hereinafter, so as to support the door in vertically suspended relationship adjacent the front side of the upright wall.

Each of the wall panels 24 and 25, in the illustrated and preferred construction, is a prefabricated arrangement defined by a ring-like outer frame 31 having a pair of generally parallel and sidewardly spaced vertical frame elements 32 which at opposite ends are rigidly joined by generally horizontally extending and generally parallel top and bottom frame elements 33 so as to define a generally rigid structure. The frame in turn supports therein a large sheet-like, upright center panel 34 which, in the preferred construction, comprises at least one large glass pane, typically a transparent sheet of glass, the edges of which are supported in a conventional manner on the horizontal and vertical frame elements 32, 33. The construction of such prefabricated upright wall panels, particularly those commonly known as "glass" panels due to the main center portion of the panel being constructed of glass, is generally well known in the art, and further description thereof is believed unnecessary.

Figure 6:
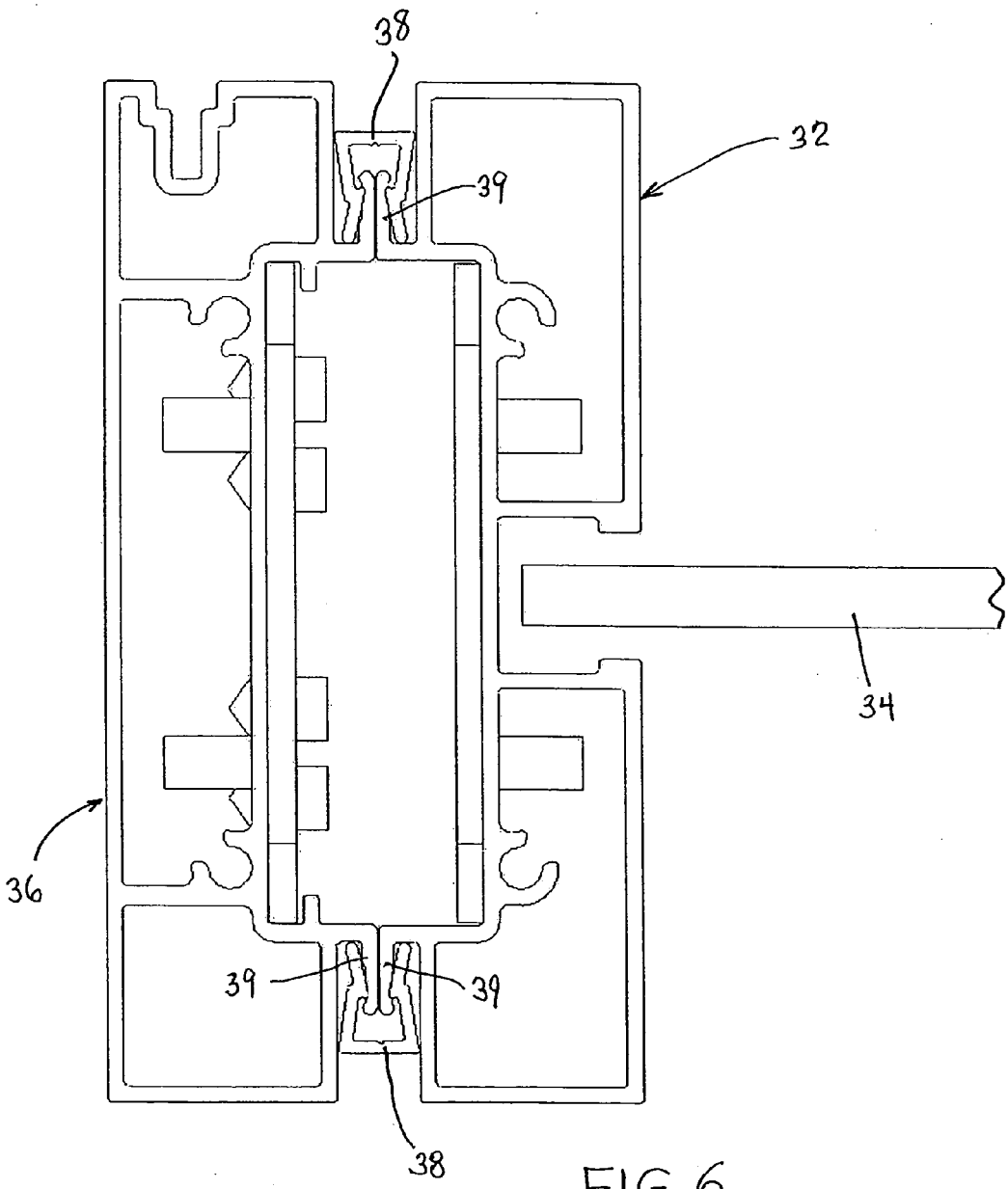
FIG. 6 is an enlarged sectional view taken generally along line 6-6 in FIG. 1.

In accordance with the present invention, the door frame 23 which rigidly joins between the spaced edges of adjacent wall panels 24 and 25, is defined by generally parallel and sidewardly spaced door frame uprights 35 and 36 which are directly rigidly joined together solely at the upper ends thereof by means of a horizontally extending structural header 37. This structural header 37 defines the upper extremity of the door opening 22, and is generally horizontally aligned with the upper horizontal frame elements 33 of the adjacent wall panels 24 and 25. In addition, in the illustrated arrangement as shown in FIG. 6, the door frame uprights 35, 36 abut the adjacent vertical side frame uprights 32 of the adjacent wall panels, which frame and panel uprights have edge flanges 39 which effectively abut to define a joint between each frame upright and adjacent, abutting panel upright. These edge flanges in turn have a vertically elongate channel-shaped clamping strip 38 engaged there-over so as to hold the adjacent vertical uprights in secure abutting engagement with one another. The clamping strips 38 have deflectable legs which create a snug clamping engagement with the overlapping flanges 39, but at the same time allow limited relative vertical positional adjustment between the adjacent frame uprights. Such clamping strips and their cooperation between adjacent upright frames is known in the art. It will also be appreciated that numerous types of connecting structures can be utilized for joining the adjacent frame uprights at each said joint.

Figure 9:
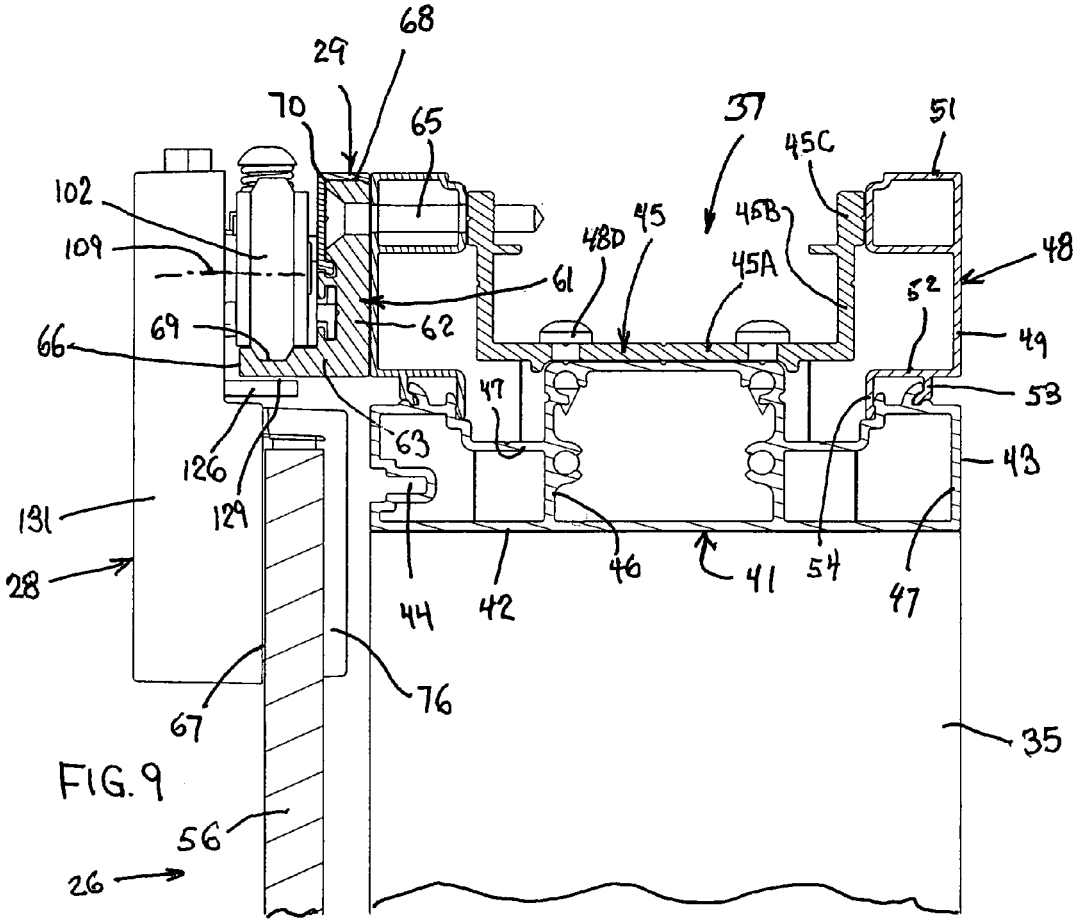
FIG. 9 is an enlarged sectional view taken generally along line 9-9 in FIG. 1.

The structural header 37 of the door frame, as illustrated by FIG. 9, comprises a horizontally-elongate header member 41 which defines a lower horizontal wall 42, the latter being the upper extremity of the doorway opening. The bottom wall 42 at opposite edges joins to upwardly protruding side walls 43, which side wall 43 adjacent the front side of the wall structure has a groove or channel 44 extending horizontally throughout the length thereof for accommodating therein a seal strip such as a brush or the like which is adapted to protrude outwardly for engagement with the back side of the door to create an acoustical seal.

The header member 41 preferably has a tubular cross-section for strength and rigidity purposes, and in the illustrated arrangement includes a generally box-shaped tubular center part 46 which protrudes upwardly from the bottom wall 42, and which is positioned sidewardly between a pair of tubular edge parts 47, the latter being defined in part by the bottom wall 42 and the respective side wall 43.

In addition to the header member 41, the header structure 37 also includes an upper trim member 48 which is carried on and protrudes upwardly from each of the tubular edge parts 47, the trim member 48 being horizontally elongate so as to extend lengthwise along the full length of the structural header. This trim member 48 includes a vertical side face 49 which is substantially co-planar with the side leg 43 of the header member 41, and this side face 49 at its upper end joins to an inwardly protruding tubular part 51. The side face 49 at its lower end joins to a leg part 52 which protrudes horizontally inwardly, and which has an intermediate hook 53 which protrudes downwardly therefrom and an inner cantilevered leg part 54 which also protrudes downwardly. The hook 53 and leg 54 cooperate with opposed hooks and shoulders defined on the tubular edge part 47 so that the trim member 48 can be engaged with the hooks on the tubular edge part 47 and then rotated into an upright position substantially as illustrated in FIG. 9 so as to create a rigid snapped engagement with the member 41.

The structural header 37 associated with the door frame 23 also includes a reinforcing beam 45 (FIG. 9) which extends horizontally throughout the length thereof. This reinforcing beam 45 in the illustrated embodiment is defined by a generally upwardly-opening channel or U-shaped member having a bottom wall 45A which seats on the upper wall of the center tubular part 46 and is rigidly joined thereto, such as by screws 48D. This reinforcing beam 45 also has generally parallel side walls or legs 45B which are cantilevered upwardly from opposite side edges of the base wall 45A. These side legs adjacent their upper edges are provided with pads 45C which effectively abut the rear inner surfaces of the tubular parts 51 associated with the upper trim member 48.

Figure 7:
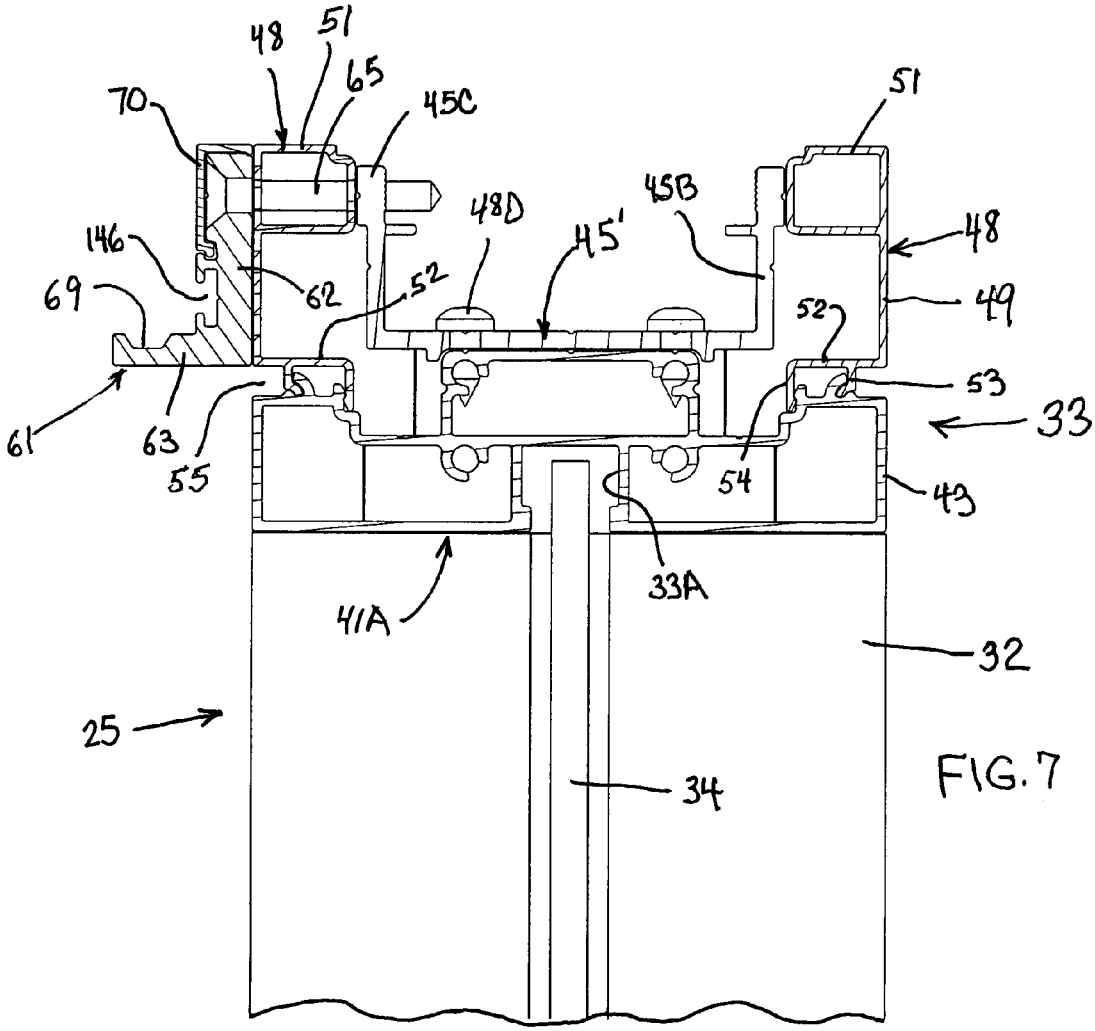
FIG. 7 is an enlarged sectional view taken generally along line 7-7 in FIG. 1.
Figure 8:
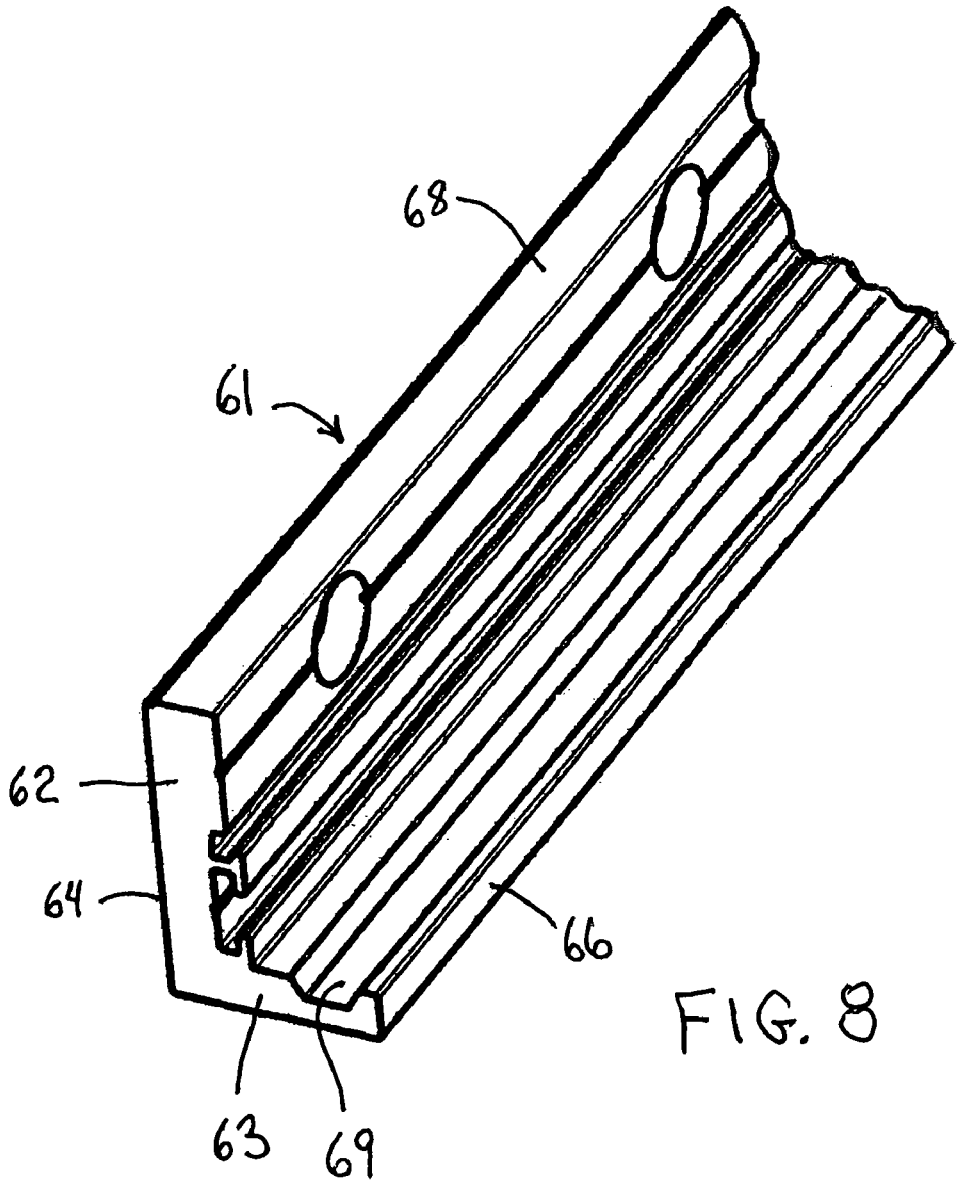
FIG. 8 is an enlarged perspective view of the rail which supports the sliding door.

The top horizontal frame 33 associated with adjacent wall panels 24 and 25, for example as illustrated in FIG. 7, includes a top horizontally elongated frame member 41A which is of a generally closed tubular construction in the preferred embodiment and has a construction and outer profile which generally corresponds to the top door frame member 41 described above, except that the panel top frame member 41A does not have an acoustical seal strip channel 44 in the side wall thereof, and the top frame member 41A has a downwardly opening channel 33A extending lengthwise along and opening upwardly from the bottom wall, which channel 33A accommodates a respective edge of the center glass panel 34. The channel 33A typically accommodates therein a conventional glazing strip (not shown) which forms a cushioned acoustical seal between the edge of the glass panel and the surrounding frame.

The upper frame 33 associated with each of the wall panels 24 and 25, in addition to the horizontal frame member 41A, also mounts thereon top trim members 48 (FIG. 7) in the same manner as described above relative to FIG. 9.

The side light panel 25 (i.e., the panel which is overlapped by the sliding door when in an opened position) also has a reinforcing beam 45' (FIG. 7) associated with and extending lengthwise along the top frame 33. The beam 45' is identical in cross-section to the beam 45 associated with the door frame, and these beams 45 and 45' are aligned end-to-end. The beam 45' is positioned sidewardly between the top trim members 48 and is seated on and fixedly secured to the center box portion of the top frame member 41A in the same manner as described above relative to FIG. 9. Alternately, the beams 45 and 45' can be formed as a continuous one-piece member having a length which extends horizontally along not only the length of the door frame header 41, but also horizontally along the length of the adjacent side light panel 25. The reinforcing beams 45 and 45' hence provide significant strength and rigidity to the overall frame header assembly associated with both the doorway frame 23 and the adjacent side light panel 25.

Considering now the construction of the sliding door 26, a preferred embodiment of which is illustrated in FIGS. 2-5, the door 26 is defined principally by a large plate-like glass pane 56, commonly referred to as a "slab," which is typically of significant thickness and of structural properties to provide requisite safety. The glass slab 56 is maintained in an upright orientation and defines thereon an upper edge 57, exposed side edges 58, and a frame or rail structure 59 which is of generally conventional construction and is fixed to and extends horizontally of the door slab along the lower edge thereof. This lower frame or rail structure 59 is generally configured in size so as to be compatible with the horizontally lower frames 33 provided on the adjacent wall panels 24 and 25 so as to provide a generally continuous look and line of sight.

The glass door slab 56 mounts the right and left roller hanger units 28 thereon adjacent the respective right and left upper corners thereof, and these latter units 28 in turn cooperate with the track arrangement 29 which is fixed to and extends horizontally along the upper header or frame structure associated with both the door frame 23 and the adjacent side light panel 25.

The track arrangement 29 is defined principally by a horizontally elongated support track or rail 61 (FIGS. 7-10) which is a one-piece structural member, preferably of metal such as aluminum. The support track 61 has a generally L-shaped cross-section defined by an upright vertical leg 62 which, at its lower end, joins to a horizontally cantilevered bottom leg 63. The vertical leg 62 has a generally flat rear face 64 which overlies and abuts against the side face 49 of the respectively adjacent top trim member 48. A plurality of horizontally spaced fasteners 65, such as screws, extend through countersunk openings formed in the leg 62 and through aligned openings in the upper tubular part 51 of the trim member 48 for threaded engagement with the pad 45C which extends along the upper edge of the leg 45D of the reinforcing beam 45. This creates a rigid securement of the support track 61 and reinforcing beam 45 to the top header members 41 and 41A as associated with the respective doorway frame 23 and side panel 25, as shown in FIGS. 9 and 7 respectively. When secured, the upper edge of the vertical track leg 62 is disposed approximately at the elevation of the adjacent top trim member 48 to provide elevational continuity of the upper edges of the adjacent panel frames and doorway frame. This also results in the horizontally cantilevered lower leg 63 of rail 61 protruding horizontally outwardly away from the top frame at a location disposed vertically between upper and lower edges thereof. In this arrangement as illustrated by FIG. 7, the bottom surface of the lower leg 63 is generally horizontally aligned with the lower horizontal leg 52 associated with the top trim member 48, which latter leg 52 cooperates with the header structure thereunder to define a sidewardly opening reveal groove 55 which extends horizontally along the upper frame approximately midway between the upper and lower edges thereof. The reveal groove 55 hence aligns generally directly below the horizontal leg 63 of the track 61 and provides improved visual aesthetics.

The rail member 61, as noted above, is a one-piece member having a length which is sized to extend lengthwise along the combined lengths of both the upper frame header of the doorway frame 23 and the upper frame member of the adjacent side light panel 25. This one-piece rail member 61 hence has a length which generally corresponds to the combined length of the aligned reinforcing beams 45 and 45', thereby providing strength and rigidity throughout the critical span which is traversed by the suspended door 26 when in either its open or closed position, or at any intermediate position.

Figure 10:
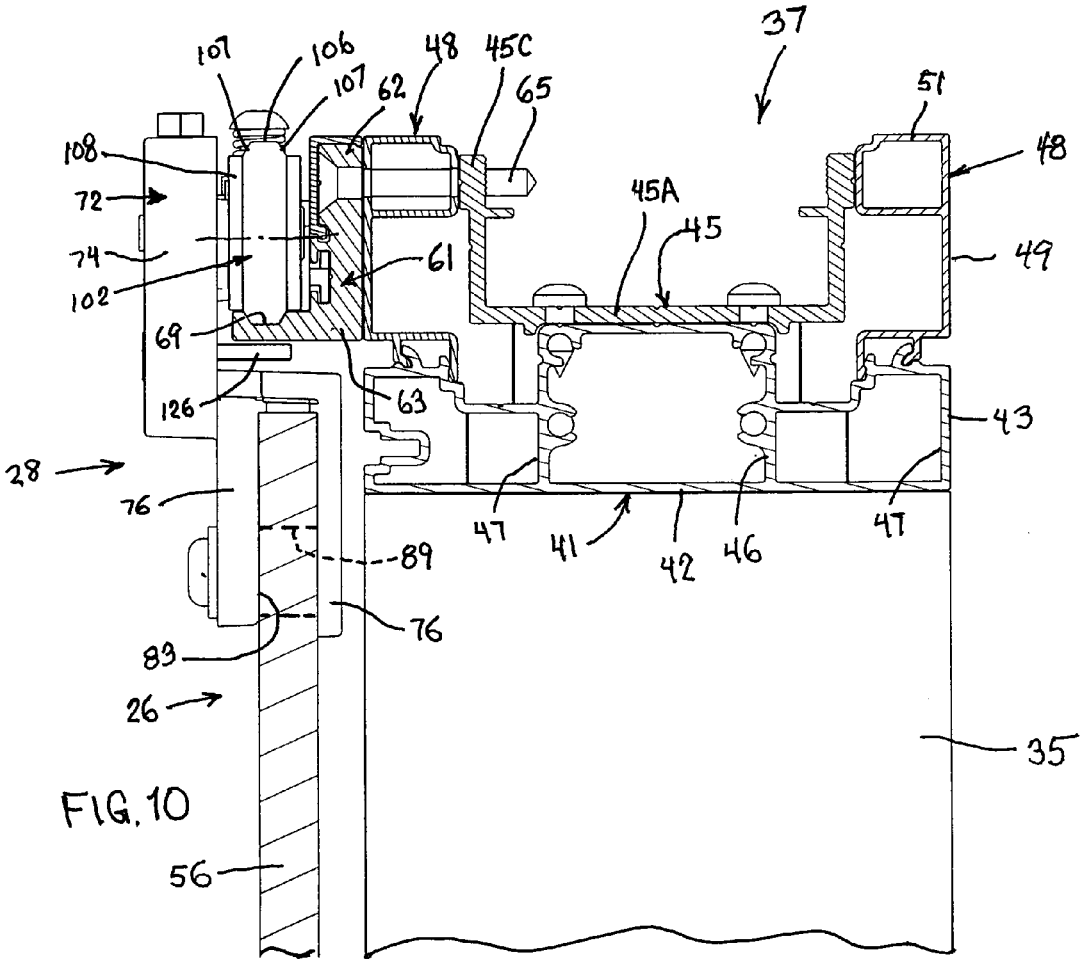
FIG. 10 is a sectional view which corresponds to FIG. 9 but illustrates the cover removed from the roller unit which supports the door.

The lower horizontally cantilevered track leg 63, as illustrated in FIGS. 9-10, protrudes outwardly a sufficient extent so as to generally overlie the upper edge of the door slab 56, and in the illustrated arrangement the lower leg 63 terminates in an outer edge surface 66 which is spaced forwardly a small distance from the vertical plane dividing the front face 67 of the slab 56. This lower track leg 63 defines thereon a generally horizontal upper surface, and a groove 69 opens downwardly from this upper surface and extends lengthwise throughout the length of the track member 61. The groove 69 is positioned inwardly a small distance from the front edge 66, and preferably has a cross-section whereby it is defined by a bottom surface which in turn is joined to side surfaces which slope upwardly and outwardly away from the bottom surface, thereby forming a configuration which is compatible with the roller 102 which is engaged therewith, as described hereinafter.

The track arrangement 29 also includes a horizontally elongate L-shaped trim cover 70 (FIG. 9) which snaps over the upper portion of the vertical track leg 62 so as to effectively cover the fasteners 65, as well as cover the upper edge 68 of the track leg 62 so as to create a substantially flush appearance with the adjacent top trim member 48.

Figure 11:
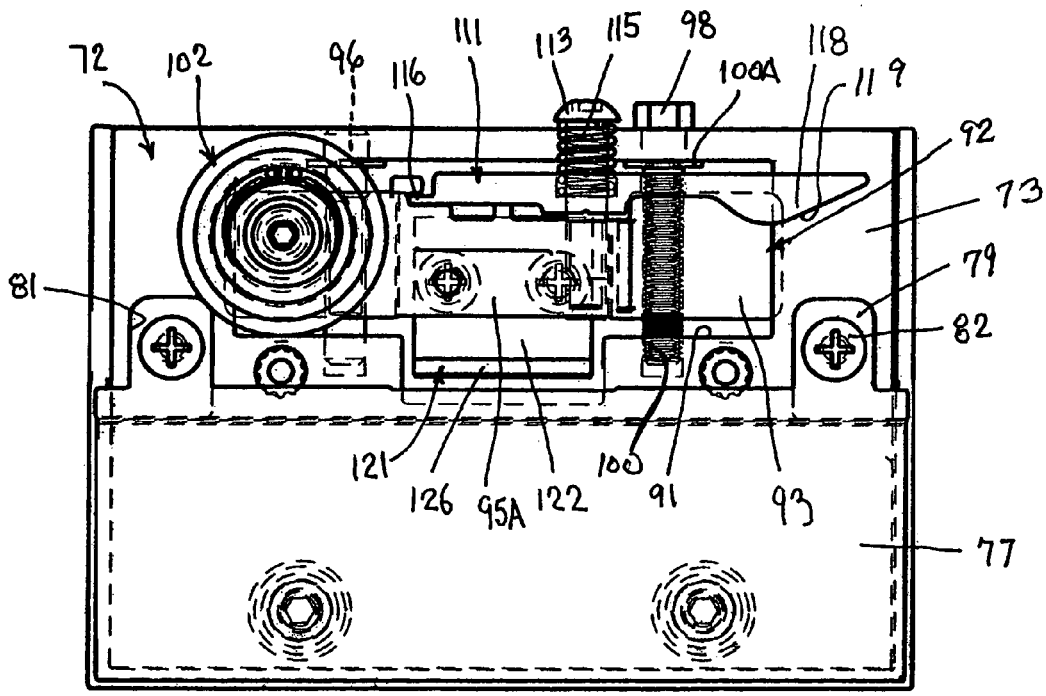
FIG. 11 is an elevational view of the assembled roller unit, shown isolated from the door, as viewed from the back side thereof, namely the side which faces the upright wall.
Figure 12:
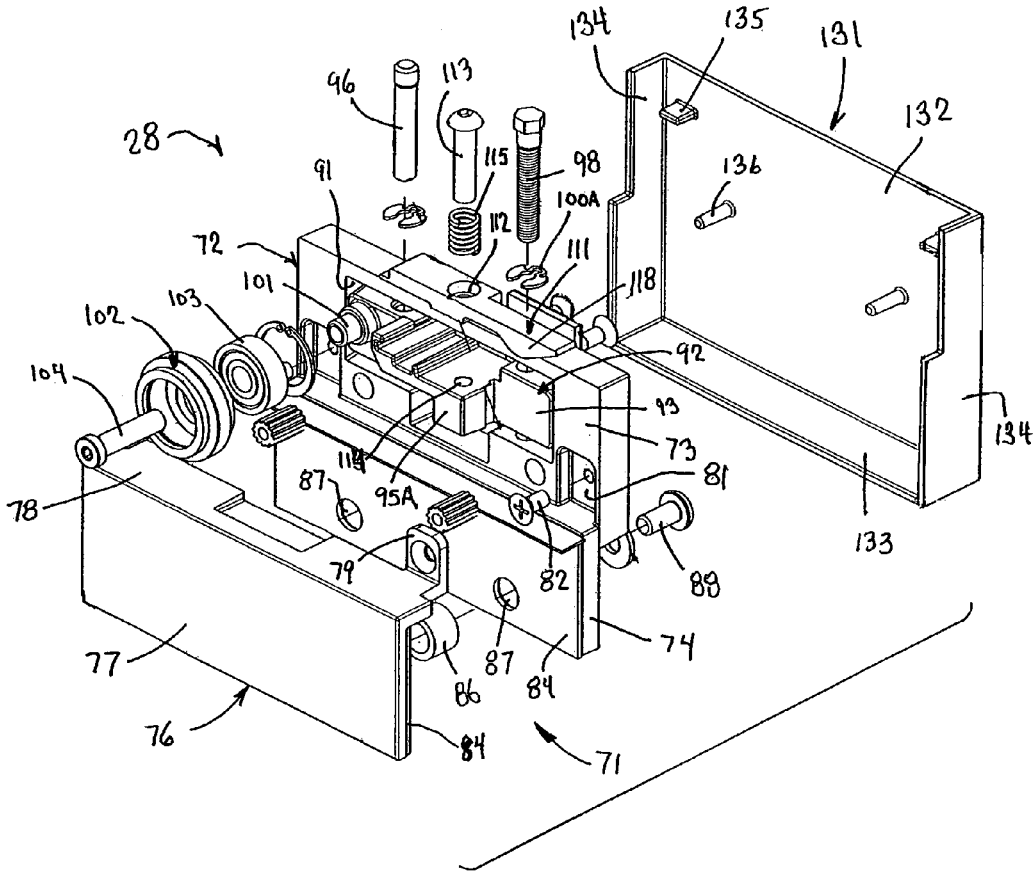
FIG. 12 is an exploded perspective view of the roller assembly as taken generally from the back side thereof.

The roller hanger units 28 which mount on the door slab 56 and which suspend it from the track member 61 will now be described in relationship to FIGS. 11-13 which illustrate the left-side hanger unit, as well as with reference to FIGS. 14-18 which illustrate various components of the roller hanger unit.

The roller hanger unit 28 includes a main bracket structure 71 defined by a main hanger bracket 72 having a door bracket 76 rigidly attached thereto.

Figure 15:
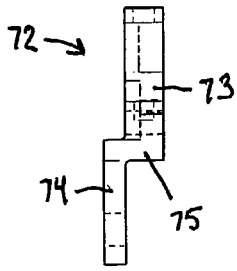
FIG. 15 is an end elevational view of the hanger bracket shown in FIG. 14.
Figure 18:
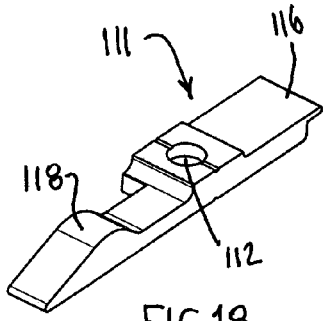
FIG. 18 is a perspective view of a stopper member associated with the roller assembly.

The main hanger bracket 72 includes a top plate-like bracket part 73 joined to a bottom plate-like bracket part 74 through a transverse bridge part 75. The hanger bracket 72 hence has a generally Z-shaped cross-section when viewed in end elevation (FIG. 15).

The door bracket 76, which cooperate with the bottom bracket part 74 for effecting clamping of the glass slab 56 therebetween, has a generally L-shaped profile in vertical cross-section, and in particular has an enlarged vertical wall part 77 which is sized similar to, and is disposed in parallel relationship with the bottom bracket part 74 of the main hanger bracket. This vertical wall part 77 at its upper edge joins to a horizontal top wall 78 which protrudes transversely toward the main hanger bracket 72, the top wall part 78 being positioned to overlie the transverse bridge part 75. The horizontal top wall 78, adjacent its free edge, has a pair of upwardly protruding tabs or flanges 79 which have openings therethrough for accommodating the tapered heads of fasteners. These tabs 79 are accommodated within recesses 81 formed in the top bracket part 79 at locations directly above the transverse bridge part 75. These recesses 81 have openings therein which accommodate screws 82, which screws project through the brackets 79 and engage the openings associated with the recesses 81 to fixedly but releasably couple the door bracket 76 to the main hanger bracket 72. When so coupled, the bottom bracket part 74 and the door bracket 76 cooperate to define a downwardly opening channel 83 for accommodating the upper edge of the glass door slab 56. The opposed faces of the vertical wall part 77 and the bottom bracket part 74 preferably have thin cushioning sheets 84 (FIG. 13), such as thin foam layers, adhered thereto for creating a safe but rigid clamped engagement with opposite sides of the glass door slab when in clamped engagement therewith as illustrated by FIGS. 9-10.

To permit clamped engagement of the upper portion of the glass slab 56 between the bracket parts 74 and 77 (herein also referred to as "clamping parts"), the clamping part 77 has a sidewardly-spaced pair of threaded support sleeves 85 protruding inwardly therefrom in aligned relationship with openings 87 formed through the opposed clamping part 74, and screws 88 extend through the openings 87 for threaded engagement with the support sleeves 85 to effect clamping engagement of the clamping parts 77 and 74 with the opposed sides of the glass slab 56. The glass slab 56, in the vicinity of the upper edge thereof, has suitable cylindrical openings 89 (FIG. 10) extending transversely therethrough, which openings 89 accommodate therein a spacer sleeve 86. The sleeve 86 in turn exteriorly surrounds the support sleeve 85 to create the desired clamping relationship between the main hanger structure and the glass slab.

The top bracket part 73 of the main hanger bracket 72 has a rather large and generally rectangular opening 91 extending transversely therethrough between the front and back sides thereof. This opening 91 in turn accommodates therein a roller support bracket 92 which is undersized relative to the opening 91 so as to permit at least limited relative movement therebetween, primarily for initial vertical position adjustability, as hereinafter explained.

Figure 16:
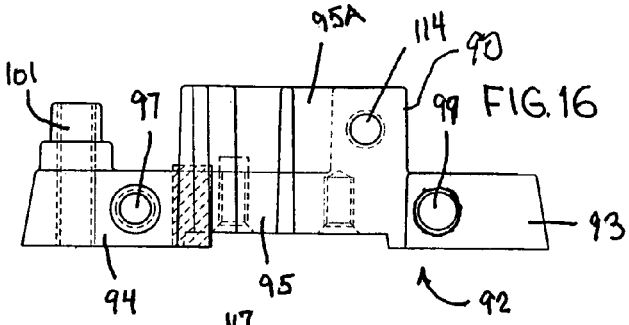
FIG. 16 is a top view of solely the roller bracket as associated with the roller assembly.
Figure 17:
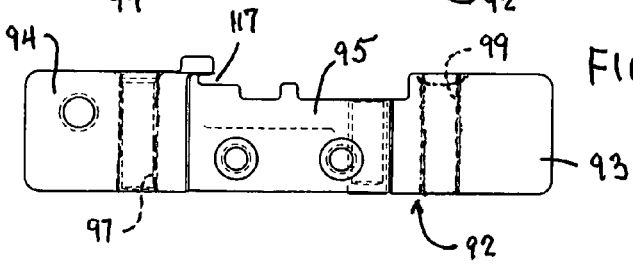
FIG. 17 is a front side elevational view of the roller bracket shown in FIG. 16.

The roller support bracket 92 has a generally horizontally-elongate block-like configuration and includes block-like end parts 93 and 94 (FIGS. 16-17) joined together by a center bridge part 95. This latter bridge part 95, as illustrated in FIG. 16, has a portion 95A which protrudes sidewardly (i.e. horizontally) in a forward direction, which protruding part 95A is positioned to generally overlie the transverse bridge part 75.

Roller support bracket 92 is supported on the hanger bracket 72 by a vertical guide pin 96 which is stationally mounted on the hanger bracket 72 and projects transversely (i.e. vertically) across the opening 91 adjacent one end thereof. This guide pin 96 extends through an elongate opening 97 which extends vertically through the block-like end part 94, with the cooperation between the pin 96 and opening 97 permitting the roller support bracket 92 to be vertically slidably displaced relative to the hanger bracket 72, to the extent permitted by the vertical clearance or spacing defined between the roller support bracket 92 and the opposed upper and lower walls of the opening 91.

The other block-like end part 93 of the roller support bracket 92 has a threaded opening 99 extending vertically therethrough in generally parallel relationship to the opening 97. This threaded opening 99 in turn cooperates with a threaded fastener 98, namely a screw, the lower end of which is rotatably guided within an opening 100 formed in the lower wall of the hanger bracket 72. The screw 98 extends vertically transversely across the opening 91, and is maintained in threaded engagement with the opening 99 formed in the roller support bracket 92. The head of the screw 98 positioned adjacent the upper surface of the hanger bracket 72 for access by an adjusting tool, and is maintained in this position by a lock clip 100A which engages the screw body and is positioned adjacent the upper wall of the opening 91. When the screw 98 is rotated, its threaded engagement with the roller support bracket 92 enables this bracket, in its entirety, to be vertically displaced a limited extent, either upwardly or downwardly within the clearance provided by the vertical spacing between the opposed upper and lower side walls of the opening 91, so as to permit limited vertical positional adjustment of the roller support bracket 92 relative to the upper edge of the door slab 56.

The roller support bracket 92 has a generally tubular cylindrical hub 101 formed thereon and protruding horizontally outwardly from the rear side thereof. This hub 101 in the illustrated embodiment is associated with and protrudes horizontally inwardly from the block-like end part 94 in the same direction as the center protrusion 95A. The hub 101 supports thereon the roller or wheel 102 through an intermediate cylindrical bearing 103, whereby the roller is rotatable about a generally horizontal axis 109 which projects in generally transverse (i.e. perpendicular) relation to the front face of the door slab 56. The roller and bearing are secured to the hub 101 by a suitable securing fastener 104. The roller 102, due to its support on the rearwardly cantilevered hub 101, is disposed rearwardly from the top bracket part 73 and, as illustrated by FIGS. 9-10, is positioned generally directly over the upper edge of the glass slab 56 while being spaced a small and defined distance above the upper edge surface of the glass slab.

The roller 102 has a generally cylindrical tread which, as illustrated in FIG. 10, has a generally cylindrical center part 106 which extends between and joins to tapered side parts 107, the latter being tapered radially inwardly as they project axially outwardly so that the side parts 107 in effect constitute truncated conical surfaces which join to opposite edges of the cylindrical center part 106. The roller 102 also includes generally cylindrical side hubs 108 which join to and protrude outwardly from the small diameter end of the respective tapered side surface 107. These cylindrical side hubs 108 are sized so as to be disposed substantially in rolling engagement with the upper surface of the horizontal track leg 63 when the center roller tread 106 is engaged within the groove 69, substantially as illustrated by FIG. 9. The cross-sectional configuration of the roller tread, as defined by the center part 106 and side edge parts 107, closely conforms to the cross-sectional configuration of the groove 69 formed in the lower track leg 63 so that the roller 102, when engaged with the groove 69 as illustrated by FIG. 9, is closely sidewardly confined to hence restrict the roller 102 solely for rolling movement in the lengthwise direction of the groove 69.

Each roller hanger unit 28 also mounts thereon a stopper member 111 which cooperates with a stop (described hereinafter) affixed to the L-shaped rail 61 for defining the limit positions of the door, namely the fully closed and fully opened positions of the door.

The stopper member 111 (FIGS. 11-13, 18) is defined by an elongate one-piece member having an opening 112 extending vertically therethrough approximately midway between the opposite free ends thereof. An elongate adjusting screw 113 extends through this opening 112, and the lower end of the adjusting screw is threaded vertically downwardly into an opening 114 formed in the protruding part 95A of the roller support bracket. A compression spring 115 surrounds the adjusting screw 113 and is captivated between the head of the screw and the upper side of the stopper member 111.

The elongate stopper member 111 is oriented to extend generally horizontally in a direction substantially parallel with the support track 61, and one end of the stopper 111 has an outwardly protruding flange 116 which protrudes into an undercut groove or recess 117 (FIG. 18) formed adjacent one side edge of the protrusion 95A, whereby this flange 116 and undercut groove 117 thereby vertically confine this end of the stopper 111 but allowing limited vertical angular displacement of the stopper.

The elongate stopper 111 adjacent its other end, namely the end which protrudes toward the adjacent vertical edge of the door slab, has a downward protrusion 118 formed thereon, the latter having a downwardly protruding exterior surface 119 having a rounded convex configuration. As the door approaches a limit position, the surface 119 on the stopper 111 engages a fixed stop, causing the stopper 111 to pivot upwardly about the flange 116, in opposition to the urging of the spring 115, with the protrusion 118 then passing over part of the stop and nesting into engagement therewith, as hereinafter described.

The roller hanger unit 28 also mounts thereon a roller anti-lift member 121 to prevent the roller 102 from accidentally lifting upwardly a sufficient extent so as to disengage from the track 61. This anti-lift member 121, as illustrated in FIGS. 11 and 13, is defined by a generally L-shaped member having an upwardly cantilevered vertical leg 122 which at its lower end joins to a horizontally cantilevered lower leg plate 126, the latter terminating at a free edge 127. The vertical leg plate 122 overlies a front face 123 defined on the center bridge part 95 of the roller support bracket 92. This front face 95 is preferably slightly recessed inwardly so as to more compactly accommodate the thickness of the vertical leg part 122 therein. The vertical leg part 122 and the center block part 95 have suitable aligned openings, the openings in the bridge part 95 being threaded, whereby suitable fasteners such as screws 124 extend through the openings in the leg part 122 and engage the threaded openings in the bridge part 95 for fixedly joining the anti-lift member 121 to the roller support bracket 92. When so fixedly secured, the lower leg plate 126 projects transversely beneath the roller support bracket 92, generally within the lower cut-out or relief portion associated with the opening 91, with the lower leg 126 protruding rearwardly through a substantial distance so that the leg 126 is positioned below but vertically spaced from the roller 102, substantially as illustrated in FIG. 9. The vertical spacing between the upper surface of the anti-lift plate 126 and the lowermost periphery of the roller tread 102 is less than the vertical thickness of the lower leg 63 as defined at the front vertical edge 66 thereof, but is preferably slightly greater than the thickness of the lower leg 63 as defined at the bottom of the groove 69, whereby the lower anti-lift leg 126 projects into a position directly below the lower leg 63 but vertically spaced therefrom by a small vertical clearance space 129 (FIG. 9) therebetween. This small vertical clearance space 129, however, is significantly less than the depth of the groove 69, thereby preventing the roller 102 from lifting upwardly sufficiently to effect disengagement from the groove 69.

Figure 13:
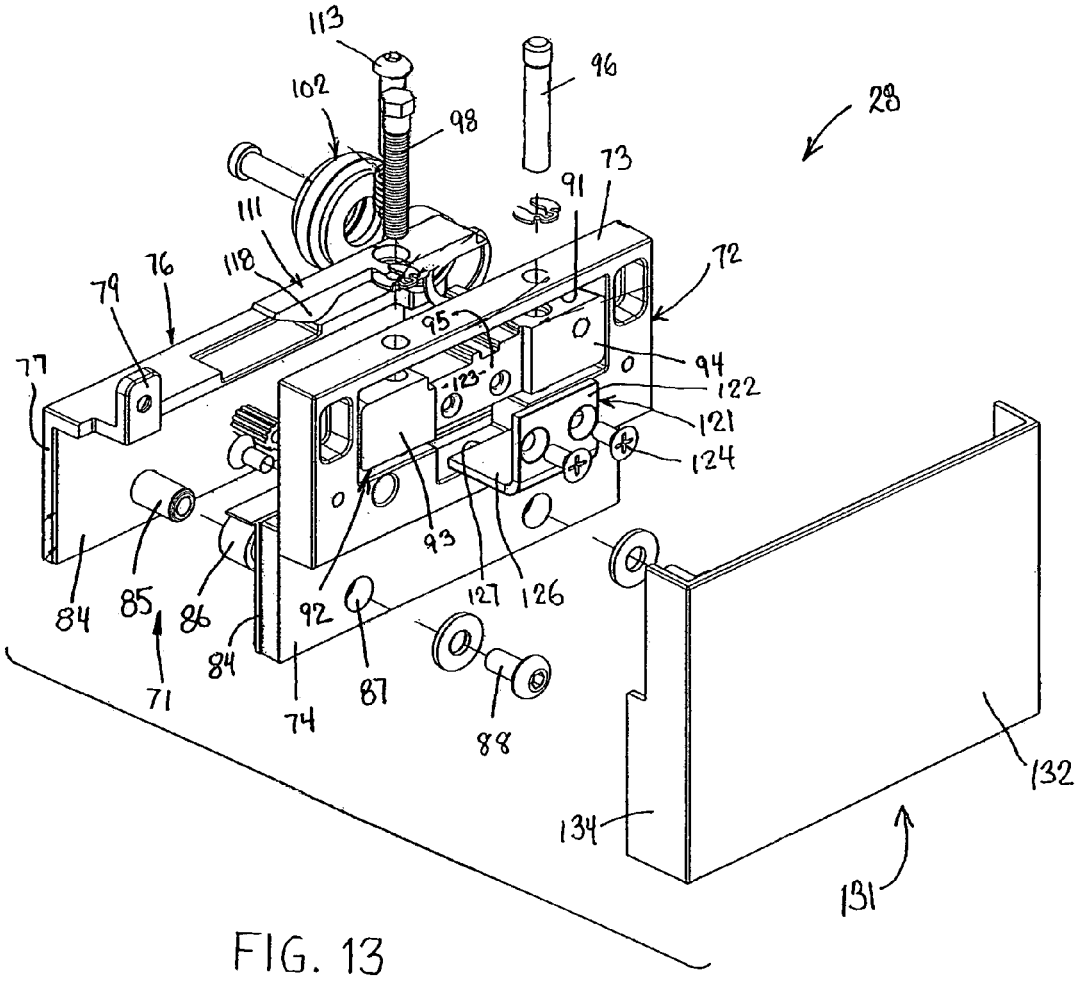
FIG. 13 is an exploded perspective view of the roller assembly as taken generally from the front side thereof.

The anti-lift member 121, as illustrated in FIG. 13, is accessible from the front side of the roller hanger unit 28 when the cover 131 is removed. Thus, after the roller units have been assembled to the door, and the door suspended from the track 61 by engaging the rollers 102 within the grooves 69, then the anti-lift member 121 is positioned so that the lower leg 126 thereof protrudes under the lower track leg 63, and the screws 124 inserted so as to secure the anti-lift member to the roller support bracket 92.

The cover 131 is then mounted onto the roller hanger unit, which cover includes an enlarged vertical front wall 132, a lower edge wall 133, and vertical side walls 134. The vertical front wall has inwardly protruding hooks 135 and guide pins 136 which cooperate with appropriate recesses or openings formed in the main hanger bracket 72 so as to permit the cover to be snapped into position to effectively enclose the roller hanger unit and hence provide a more pleasing appearance.

Prior to mounting of the covers 131 on the roller units, the roller support bracket 92 and its associated roller 102 of each hanger unit 28 can be vertically adjusted relative to the main hanger bracket 72 by engaging an appropriate tool with the head of the screw 98 and effecting rotation thereof in one direction or the other so as to effect limited raising or lowering of the respective roller bracket 92 relative to the hanger bracket 72, thereby adjusting the elevation of the lower edge of the door adjacent either or both lower corners thereof, depending upon whether one or both roller units 28 are adjusted, thereby enabling proper alignment of the lower edge of the door with the adjacent wall panels. This adjustment in alignment can hence be accomplished after the door has been fully assembled onto the support track 61.

Figure 19:
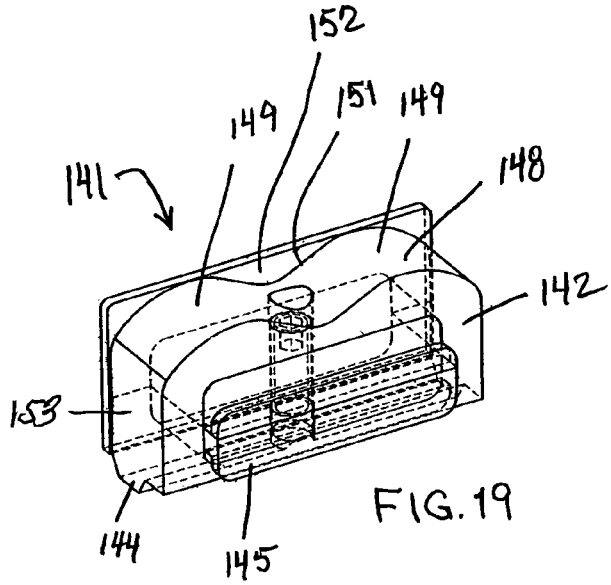
FIG. 19 is a rear perspective view of a stop which mounts on the support track for cooperation with the stopper member of FIG. 18.
Figure 21:
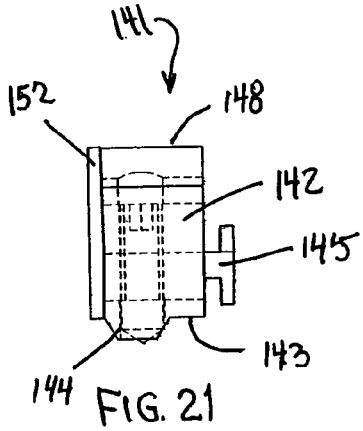
FIG. 21 is an end elevational view of the stop shown in FIG. 20.
Figure 20:
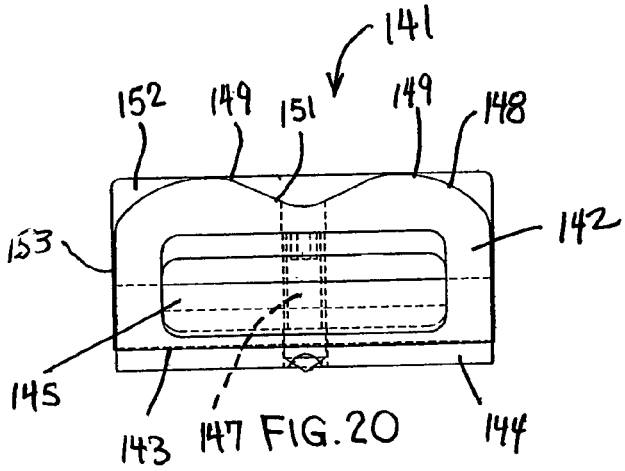
FIG. 20 is a back side elevational view of the stop shown in FIG. 19.

As illustrated in FIG. 1, the support track arrangement 29 is preferably provided with a pair of stops 141 fixedly secured thereto in spaced relationship, whereby these stops respectively define the fully opened and fully closed positions of the door. A preferred embodiment of the stop 141 is illustrated in FIGS. 19-21. The stop 141 is a one-piece member defined by a block-like main body 142 having a generally flat bottom surface 143 provided with a downward protrusion 144, the latter extending lengthwise along the bottom surface and having a size and configuration which corresponds generally to the roller support groove 69 formed in the lower track leg 63. The stop 141 has a guide flange 145 which protrudes outwardly from the rear surface thereof, which guide flange 145 in vertical cross-section has a generally T-shaped configuration which is shaped and sized so as to be inserted into and slidable horizontally along a similar T-shaped undercut groove 146 which opens into the upright track leg 62 from the front face thereof and which extends horizontally lengthwise along the upper track leg. A fastener securing member such as a set screw 147 is provided in the main body 142 and projects downwardly so as to be rotated into gripping engagement with the bottom of the track groove 69.

The main body 142 of the stop also has a contoured upper surface 148 which includes a pair of upwardly-oriented convex protrusions 149 which are sidewardly spaced apart and which define a smoothly curved concave valley or recess 151 therebetween. The stop 141 also has an upwardly protruding front edge flange 152 which extends along the upper front edge of the block member and which partially closes off the front edge of the contoured upper surface 148.

The stop 141 is mounted on the rail 61 by slidably engaging the T-flange 145 and the protrusion 144 into the respective T groove 146 and roller tread groove 69 on the support rail 61. The stop 141 is then slidably moved to its desired position and, when such position is reached, the set screw 147 is tightened into engagement with the track to effectively lock the stop in position. Loosening of the set screw permits the position of the stop to be easily adjusted and re-secured in the newly adjusted position.

When the door approaches the stop 141, the protrusion 118 on the stopper 111 engages the leading protrusion 149 on the stop 141, causing the stopper 111 to be pivotally cammed upwardly against the urging of spring 115, which spring urges the projection 118 to snap downwardly into the recess or valley 151 so as to hold the door in its end position, while preventing the door from rebounding away from the end position. When reaching this end position, the side surface 90 of the bracket protrusion 95 is disposed closely adjacent and directly opposed to the end surface 153 of the stop 141.

The suspended door 26 may also be provided with a lower stop 154 for defining the same closed and open limits of the door as defined by the upper stops 141. This lower stop 154 is secured to and protrudes inwardly from the inner or back side of the door, being secured to the lower frame or bracket structure 59, and has a suitable resilient or elastomeric stop at one end thereof which is adapted to engage the door frame upright 35 when the door reaches its closed position. This same stop 154 can be double-ended and have another cushioning stop associated with the other end thereof, which latter cushioning stop is positioned for engaging the opposite door frame upright 36 when the door reaches its open position, in which position the leading edge 26 of the door is typically positioned so as to project at least a limited extent into the door passage 22.

Figure 22:
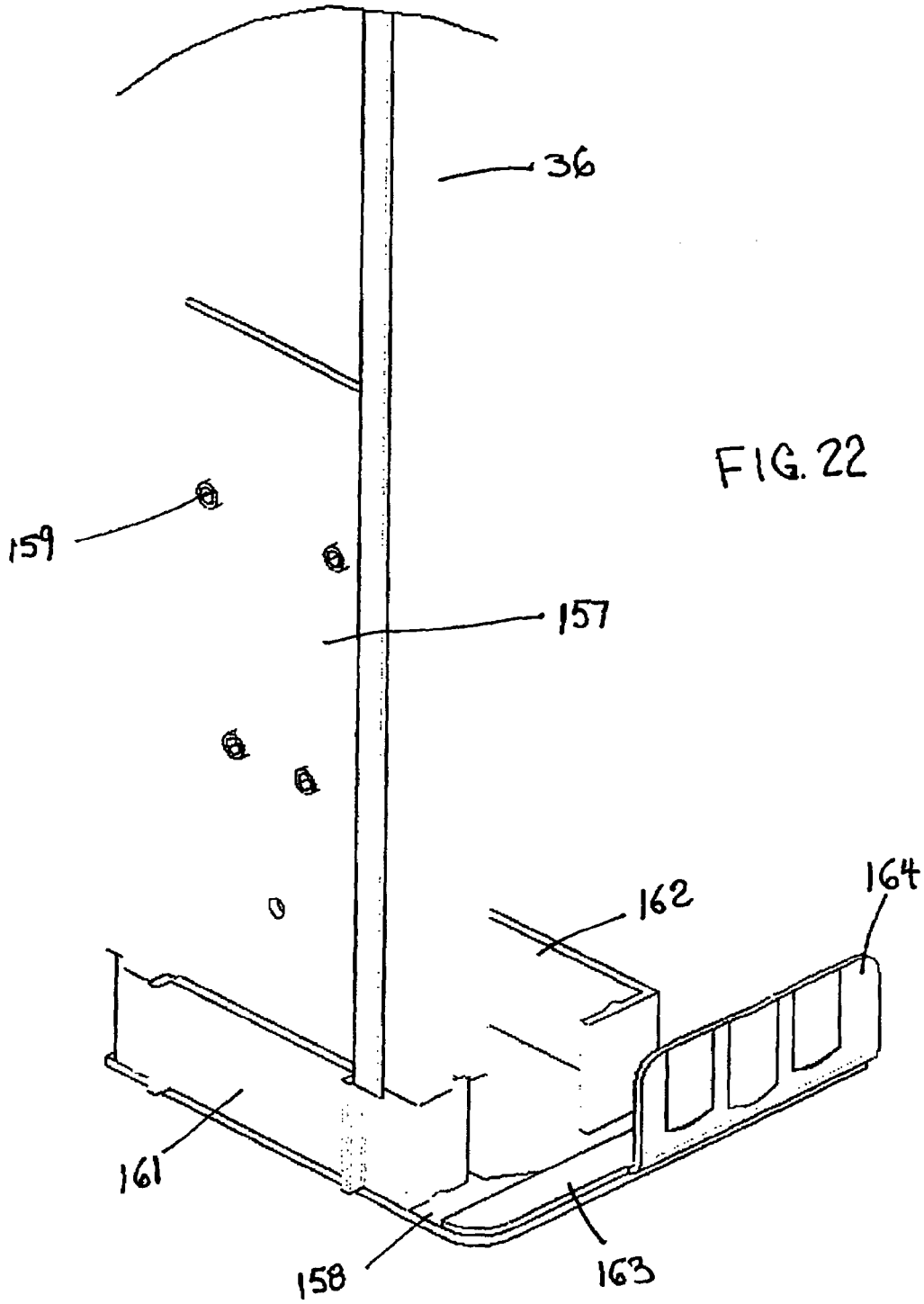
FIG. 22 is a fragmentary perspective view which illustrates a lower end of a door frame upright and its cooperation with a guide which slidably guides the lower edge of the sliding door.
Figure 22A:
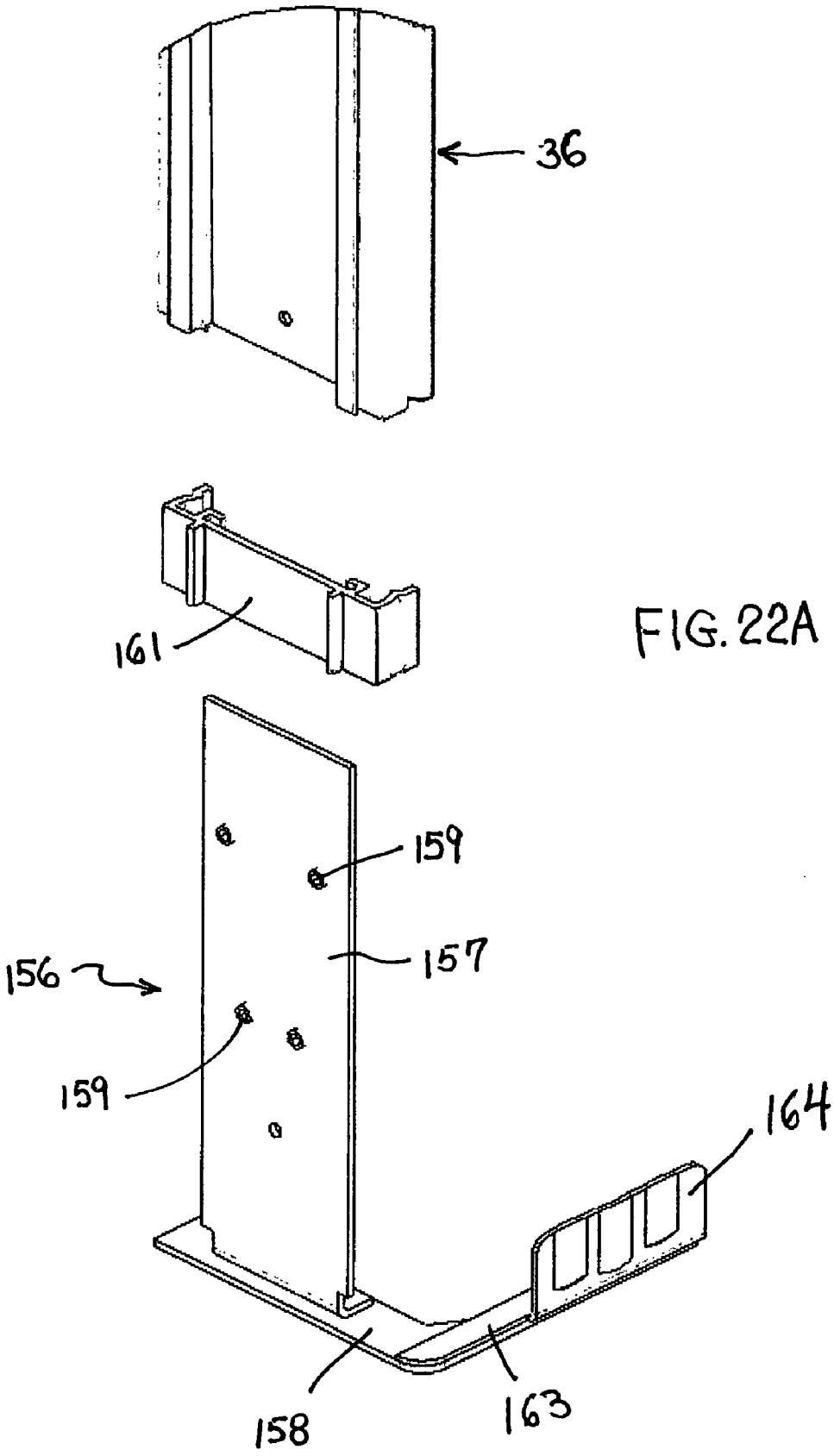
FIG. 22A is an exploded perspective view of the arrangement shown in FIG. 22.
Figure 22B:
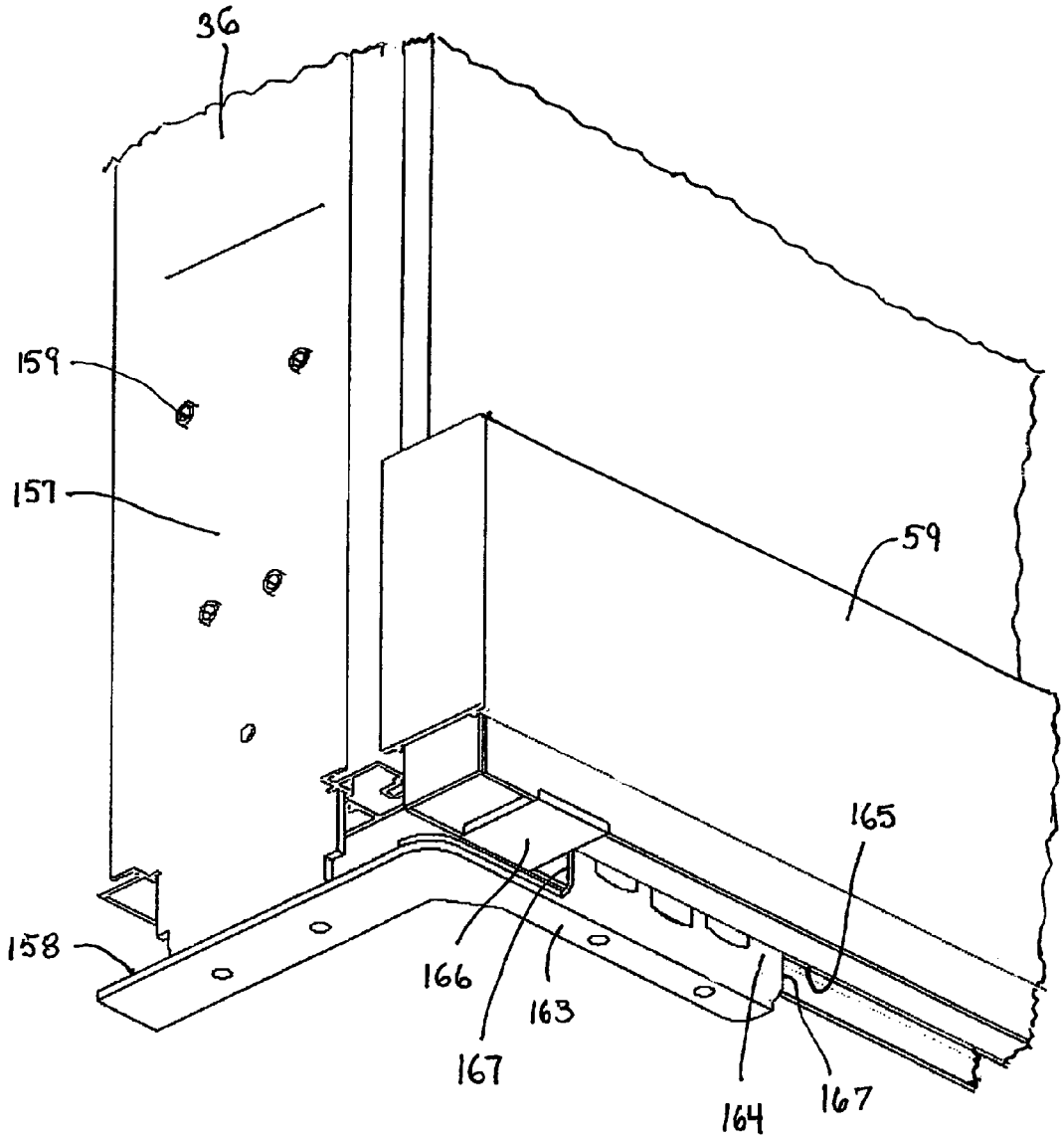
FIG. 22B is a perspective view, taken from below the door, and showing the arrangement of FIG. 22.

To further assist in controlling and guiding the permissible movement of the door, the sliding door 26 is typically and conventionally provided with a lower guide structure which cooperates for slidably gliding the lower edge of the door, while preventing the lower edge from being sidewardly displaced either toward or away from the adjacent wall panels. One way of accomplishing this latter restraint of the lower edge of the door is illustrated in FIGS. 22, 22A and 22B which illustrates the lower edge of the door frame upright 36. This upright 36, as well as the opposed door frame upright 35, has a height-adjusting support foot assembly 156 secured thereto and protruding downwardly therefrom, the latter permitting elevational height adjustment of the door frame upright relative to the floor. The support foot assembly 156 includes a floor-engaging support plate 158 having a guide plate 157 projecting vertically upwardly therefrom, the latter being vertically slidably engaged within grooves formed in the frame upright 36 so as to permit height adjustment of the upright relative to the floor. The guide plate 157 is fixed to the upright 36 at the desired elevational position by a series of set screws 159. Suitable cut-to-length trim covers 161 and 162 can be provided so as to close off the lower end of the door frame uprights 35 and 36.

The foot assembly associated with only one of the frame uprights 35 and 36, namely the upright 36 in the illustrated embodiment, also has a lower door guide fixedly joined thereto. This door guide includes a plate or leg 163 which is fixed (e.g. welded) to the outer end of the floor support plate 158. This plate or leg 163 extends parallel with the door movement and mounts thereon an upwardly protruding but horizontally elongated guide plate 164. This guide plate 164 projects into a narrow groove 165 (FIG. 22B) which projects upwardly within and extends lengthwise along the lower door frame 59. The guide plate 164 remains engaged within the groove 165 along the lower frame of the door at all times so as to prevent sideward displacement of the lower edge of the door, while at the same time permitting unrestricted sliding displacement of the door between its open and closed positions.

In a preferred embodiment of the invention, and as an alternative to the external lower stop 154 described above, lower stops can be provided directly on the bottom door frame 59 for abutting cooperation with the ends of the upright door guide 164. More specifically, as illustrated in FIG. 22B, stops 166 can be fixed to the bottom door frame 59 adjacent opposite ends of the door groove 165 which accommodates the guide 164 therein. Such stops are positioned to abut the opposed upright ends 167 of the upward protruding guide 164 and, in conjunction with the top stops, function to define the opened and closed positions of the door. These lower stops 166, however, are generally secondary in operation, with the primary stopping function being performed by the top stop.

In the improved wall arrangement of the present invention, specifically the improved wall having a sliding door associated therewith and incorporating therein the improved support rail and hanger arrangement as herein described, the wall and the door frame, as well as the sliding door suspended from the door frame and the adjacent side light panel, can all be supported directly from the floor, whereby securement of significant load-bearing structure to the ceiling or to some other rigid wall structure is unnecessary. Further, the loads of the suspended sliding door can be readily and safely accommodated solely by the reinforced upper header or frame structure 37 and 33 associated with the door frame and the adjacent side light panel, which loads can be readily transferred vertically through the side uprights of the door frame and the adjacent side light panel to the floor. At the same time the overall height of the roller and support track arrangement for the door can be significantly minimized by enabling both the roller 102 and the support track 61 to have similar vertical heights, with the roller and track being disposed in sidewardly adjacent relationship whereby they, in their entirety, substantially vertically overlap one another, thereby significantly minimizing the overall height, which in turn permits both the upper frame of the doorway and the upper frame of the adjacent panels to be substantially similar both in appearance and in vertical extent, thereby providing a much improved overall appearance to the wall, particularly along the upper edge thereof, and at the same time minimizing any overlap or obstruction with respect to the glass slab or pane which defines either the side light panel or the glass door panel.

This improved roller-track arrangement, in addition to its vertical compactness, also further simplifies the overall structure by permitting both the track and the roller units to be generally vertically exposed, with the compactness of both the track and the roller units, and the manner in which the track is configured and blends into the structure of the top frames, providing a visually pleasing appearance, whereby the providing of a large enclosing shroud for the track and roller arrangement is believed unnecessary. The improved roller-track arrangement also permits the door to be easily and efficiently mounted on the track, after which the roller anti-lift members can be installed, and the roller support brackets vertically adjusted independently at each corner of the door so as to achieve desired alignment, particularly along the lower edge of the door.

While the track and hanger arrangement described above are directed to a slab-type glass door, it will be appreciated that this improved track and roller hanger arrangement are also applicable for use on doors and particularly glass doors wherein the glass panel or slab is enclosed within a surrounding frame.

Figure 23:
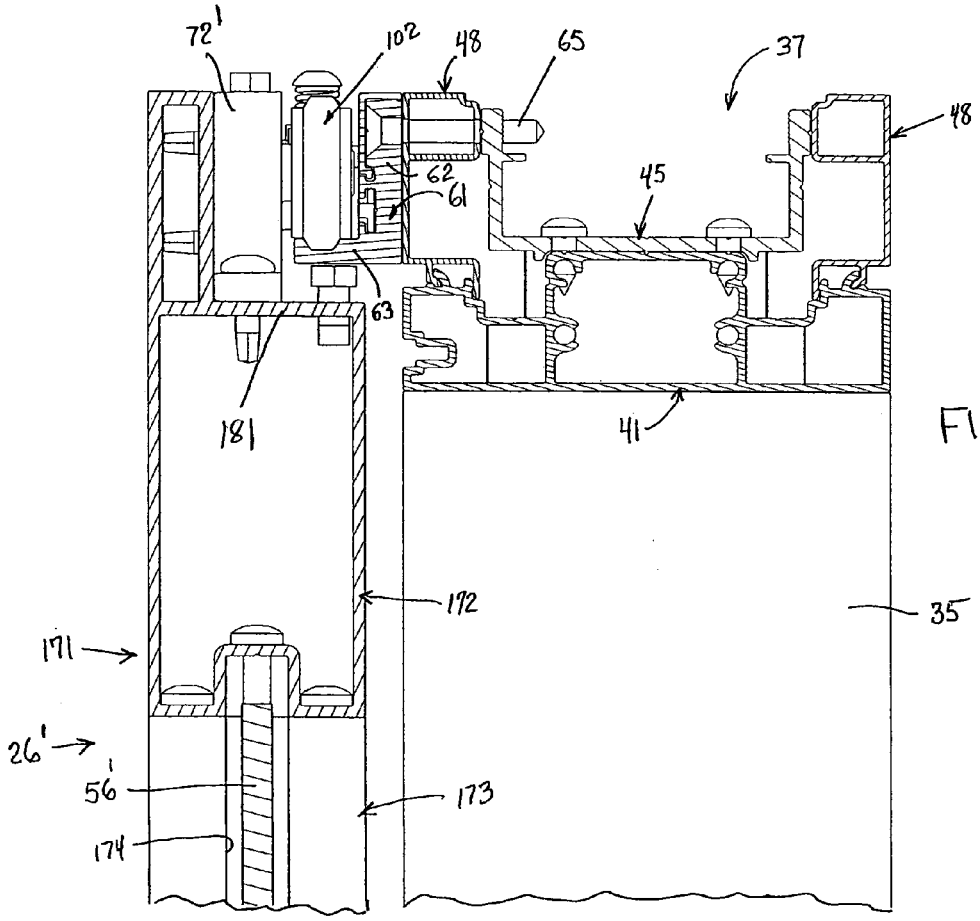
FIG. 23 is an enlarged cross-sectional view similar to FIG. 8 but illustrating a modified door construction.

Relative to this latter modification, attention is directed to FIG. 23 which is a fragmentary sectional view similar to FIG. 10 but wherein the slab door of FIG. 10 has been replaced by a framed door.

Figure 14:
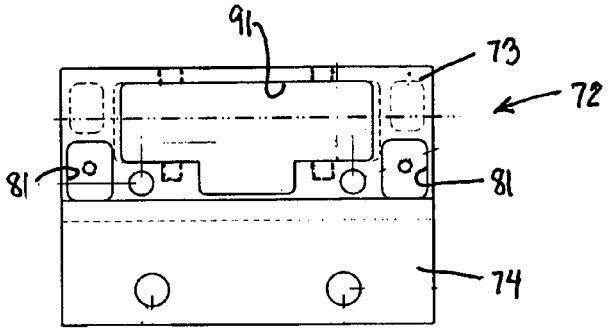
FIG. 14 is a front side view of solely the hanger bracket as associated with the roller assembly.

More specifically, in FIG. 23 there is illustrated a door frame wherein the door passage has an upright 35 along the side, and a horizontal header 41 extending across the top, the latter being reinforced by the reinforcing beam 45, the latter cooperating between the header beam 41 and the top trim members 48, with the L-shaped track or rail 61 being secured by fasteners 65 in the same manner as described above. In the arrangement of FIG. 23, however, the door 26 includes a slab or pane 56' which is enclosed within a surrounding ring-shaped rigid frame 171 which includes a horizontally extending top frame member 172 which joins to upper ends of vertical side frame members 173 which, at lower ends, are joined to a similar bottom frame member, with all of these frame members having a typical groove 174 extending lengthwise along the inner surface for accommodating therein an edge of the glass slab 56', which edges are typically supported within conventional cushioning glazing strip. In this construction of the door 26', since the glass slab 56' is itself supported within a surrounding frame, the roller hanger units which connect to the door do not mount directly to the glass slab 56', but rather couple directly to the top frame member 172. This top frame 172, in the illustrated embodiment, is defined as a generally hollow tubular or box-like structure, and the roller hanger unit is mounted on the top wall 181 of the top frame 172. Due to the different mounting arrangement required, the roller hanger unit is provided with a modified main hanger bracket 72', the latter being defined solely by the top plate part 73 as illustrated in FIG. 14-15, the lower plate part 74 not being required since direct clamping to the glass slab is not required.

Figure 24:
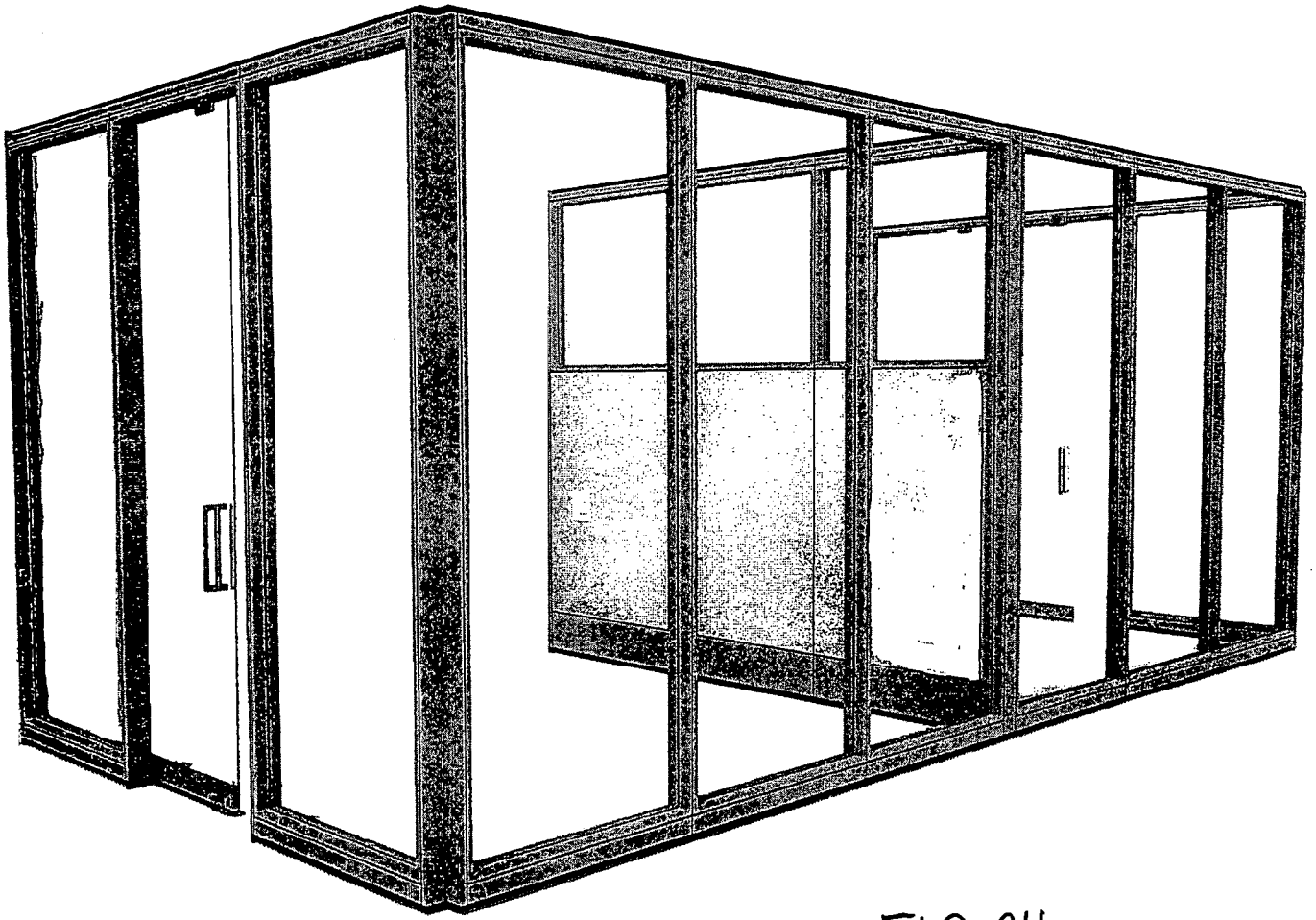
FIG. 24 is a perspective view of a wall arrangement which cooperates to define an interior work space or room, and which illustrate an exemplary use of a wall having a doorway and an associated sliding door associated therewith in accordance with the present invention.

Referring now to FIG. 24, there is illustrated an office arrangement defined by a plurality of upright wall structures which are joined to define several of the walls defining an office or work space. One of the walls has a doorway associated therewith, the wall and the doorway associated therewith having a sliding door which is constructed in accordance with the invention as described above. The arrangement of FIG. 24 illustrates only one application of the present invention, and it will be appreciated that numerous other arrangements of the wall and the association of the sliding door therewith can be provided.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. An upright interior wall structure disposed in supportive engagement with a floor, comprising:

a first prefabricated upright wall panel disposed in supportive engagement on a floor;

said wall panel including a frame assembly having upright edge frame members disposed adjacent opposite side edges thereof, and a horizontally elongate top frame structure extending between and having opposite ends rigidly joined to upper ends of said upright edge frame members wherein said edge frame members jointly carry vertical loads on said top frame structure;

an inverted U-shaped door frame defining a door opening extending transversely therethrough, said door frame including parallel right and left upright side frame members disposed in sidewardly spaced relation and defining opposite edges of said door opening which is defined therebetween, and an elongate upper frame structure extending horizontally between and having opposite ends terminating at and rigidly joined to upper ends of the right and left side frame members wherein said side frame members jointly carry vertical loads on said upper frame structure;

said door frame being positioned sidewardly adjacent and joined to said first wall panel in horizontally aligned relation so that one of said upright side frame members is positioned adjacent and connected to one of said edge frame members to define a respective joint therebetween and said wall panel extends away from said door frame and said door opening, and the top frame structure and the upper frame structure are disposed in adjacent end-to-end relationship with one said end of said top frame structure and an adjacent said end of said upper frame structure being disposed together at said joint;

a horizontally elongate support track fixed to and extending horizontally along said top and upper frame structures adjacent one exterior side face thereof so as to span said joint, said support track having opposite ends spaced in opposite directions away from said joint and including an upright first leg which overlies a side face of each of the aligned upper and top frame structures and is fixedly joined thereto such that vertical loads on said support track are transferred to and jointly carried by said edge frame members and said side frame members, and a second leg which is joined to said first leg and which is cantilevered horizontally outwardly away from said exterior side face, said second leg having an upper surface provided with a roller-accommodating guide protruding vertically thereof and extending lengthwise therealong;

a sliding door suspended laterally adjacent one side of said wall panel and suspended vertically from said support track and movable horizontally therealong across said joint between a closed position wherein the door overlies and closes off the door opening and an open position wherein the door primarily overlies an exterior side face of said first upright wall panel; and said door mounting thereon, adjacent opposite upper corners thereof, a pair of roller-hanger units each having a roller cantilevered in rearward relationship relative to the door and positioned above the second leg of the support track so that the roller is engaged with the roller-accommodating guide, said roller being sized so that it does not significantly protrude above the top and upper frame structures.

2. A wall structure according to claim 1, wherein said door is defined principally by a large plate-like glass slab.

3. A wall structure according to claim 1, wherein the support track comprises a horizontally-elongate one-piece support rail having a generally L-shaped cross-section and extending lengthwise along solely the top and upper frame structures as associated with the respective door frame and first upright panel.

4. A wall structure according to claim 1, wherein the roller-hanger unit includes a vertical adjustment structure which permits the position of the roller to be vertically adjusted relative to the door when the roller-hanger unit is mounted to the door and the roller is engaged with the second leg of the support track.

5. An interior wall according to claim 4, wherein the roller-hanger unit includes a main hanger bracket which is fixedly carried on the door adjacent an upper edge thereof, a roller bracket which is movably carried on the main hanger bracket and which mounts the roller thereon, and the vertical adjustment structure coupling the roller bracket to the main hanger bracket to permit vertical adjustment therebetween, said vertical adjustment structure including an upwardly protruding adjusting member which is accessible when the roller-hanger unit is secured to the door and the roller is engaged with the support track so as to permit vertical adjustment of the roller relative to the door when the door is suspended from the support track.

6. A wall structure according to claim 5, wherein the support rail has a generally L-shaped cross section, and wherein the second leg is horizontally cantilevered outwardly from adjacent a lower end of said first leg.

7. A wall structure according to claim 6, wherein the door is defined principally by a large plate-like glass slab.

8. A wall structure according to claim 1, wherein the upper frame structure of the door frame includes a horizontally elongate top frame member having a generally tubular cross-section.

9. A wall structure according to claim 1, wherein each of the top and upper frame structures have respective top frame members which have upwardly-opening channel-shaped cross-sections and have opposite ends supported respectively on said edge and side frame members, and a horizontally elongate reinforcing beam positioned interiorly of and extending lengthwise along each of the top and upper frame members and rigidly joined thereto, said reinforcing beams having a combined length which generally corresponds to the length of said support track and being rigidly joined thereto such that loads on said support track are transferred to said top frame members and thereby to said side and edge frame members.

10. A wall structure according to claim 9, wherein each of said top and upper frame structures is defined by a main horizontally-elongate one of said top frame members having a generally tubular cross-section and having a pair of horizontally-elongate top trim members removably fixed thereto and protruding upwardly from adjacent opposite sides thereof to define the generally channel-shaped cross-section of the respective frame member, and said reinforcing beam being positioned sidewardly between the top trim members and seated on and rigidly joined to the top frame member associated with the respective door frame and first panel.

11. A wall structure according to claim 10, wherein the one-piece support track and the reinforcing beams extend along solely the length of the upper frame structure and the top frame structure and are disposed in abutting contact with opposite sides of one of the top trim members and are rigidly joined together by fasteners which extend from the support track through the top trim member to the reinforcing beam to transfer loads from said support track to said reinforcing beams.

12. A wall structure according to claim 11, wherein the support rail has a generally L-shaped cross section, and wherein the second leg is horizontally cantilevered outwardly from adjacent a lower end of said first leg.

13. An interior wall according to claim 10, wherein the track as mounted on the top and upper frame structures is free of shrouds or other enclosures wherein said top frame members and said top trim members define exterior side faces which are substantially exposed, and wherein the upper edge of the interior wall structure is free of load-bearing connections to the adjacent ceiling.

14. A wall structure according to claim 1, wherein vertical loading created by the door on said support track is transmitted solely to the top and upper frame structures associated with the respective door frame and first upright panel and is then transmitted vertically downwardly to the floor through the side frame members and edge frame members.

15. A wall structure according to claim 1, wherein the support rail has a generally L-shaped cross section, and wherein the second leg is horizontally cantilevered outwardly from adjacent a lower end of said first leg.

16. A wall structure according to claim 15, wherein the door is defined principally by a large plate-like glass slab.

17. An upright interior wall structure disposed in supportive engagement with a floor, comprising:

a first prefabricated upright wall panel disposed in supportive engagement on a floor;

said wall panel including a frame assembly having upright edge frame members disposed adjacent opposite side edges thereof, and a horizontally elongate top frame structure extending between and having opposite terminal ends rigidly joined to upper ends of said upright edge frame members;

an inverted U-shaped door frame defining a door opening extending transversely therethrough, said door frame including parallel right and left upright side frame members disposed in sidewardly spaced relation and defining said door opening therebetween with opposite side edges of said door opening being defined by said right and left side frame members, and an elongate upper frame structure extending horizontally between and having opposite terminal ends rigidly joined to upper ends of the right and left side frame members;

said door frame being positioned sidewardly adjacent and joined to said first wall panel in horizontally aligned relation so that one of said upright side frame members is positioned adjacent and connected to one of said edge frame members such that said wall panel extends away from said door frame and said door opening, the top frame structure and the upper frame structure being disposed in adjacent end-to-end relationship;

a horizontally elongate support track fixed to and extending horizontally along said top and upper frame structures adjacent one exterior side face thereof, said support track including an upright first leg which overlies a side face of the aligned upper and top frame structures and is fixedly joined thereto, and a second leg which is joined to said first leg and which is cantilevered horizontally outwardly away from said exterior side face, said second leg having an upper surface provided with a roller-accommodating guide protruding vertically thereof and extending lengthwise therealong;

each of the top and upper frame structures having upwardly-opening channel-shaped cross-sections, and a horizontally elongate reinforcing beam being positioned interiorly of and extending lengthwise along each of the top and upper frame structures so as to be hidden within said frame structures and said beams being rigidly joined thereto, said reinforcing beams having a combined length which generally corresponds to the length of said support track and being rigidly joined thereto;

the one-piece support track and the reinforcing beams extending along solely the length of the upper frame structure and the top frame structure and being rigidly joined together by fasteners which extend from the support track to the reinforcing beam such that loads on said support track are carried by said reinforcing beams;

a sliding door suspended laterally adjacent one side of said wall panel and suspended vertically from said support track and movable horizontally therealong between a closed position wherein the door overlies and closes off the door opening and an open position wherein the door primarily overlies an exterior side face of said first upright wall panel; and said door mounting thereon, adjacent opposite upper corners thereof, a pair of roller-hanger units each having a roller cantilevered in rearward relationship relative to the door and positioned above the second leg of the support track so that the roller is engaged with the roller-accommodating guide, said roller being sized so that it does not significantly protrude above the top and upper frame structures.

18. A wall structure according to claim 17, wherein each of said top and upper frame structures is defined by a main horizontally-elongate top frame member having a generally tubular cross-section and having a pair of horizontally-elongate top trim members fixed thereto and protruding upwardly from adjacent opposite sides thereof to define the generally channel-shaped cross-section of the respective frame structure, said reinforcing beam being positioned sidewardly between the top trim members and seated on and rigidly joined to the top frame member associated with the respective door frame and first panel, and said support track and the reinforcing beams being disposed in abutting contact with opposite sides of one of the top trim members.

19. A wall structure according to claim 17, wherein vertical loading created by the door is transmitted solely to the top and upper frame structures and the reinforcing beams associated with the respective door frame and first upright panel and is then transmitted vertically downwardly to the floor through the side frame members and edge frame members.

20. An interior wall according to claim 17, wherein the support track as mounted on the top and upper frame structures has a cover overlying said fasteners on a portion of said first leg and is free of shrouds or other enclosures such that said second leg is exposed.

21. An interior wall according to claim 20, wherein said first leg has an upper leg portion thereof formed with fastener bores through which said fasteners extend to join said support track to said upper and top frame structures, said cover being removably connected to said upper leg portion to enclose said fasteners and define an exposed surface free of visible fasteners.

22. An interior wall according to claim 17, wherein the roller-hanger unit includes a main hanger bracket which is fixedly carried on the door adjacent an upper edge thereof, a roller bracket which is movably carried on the main hanger bracket and which mounts the roller thereon, and the vertical adjustment structure coupling the roller bracket to the main hanger bracket to permit vertical adjustment therebetween, said vertical adjustment structure including an upwardly protruding adjusting member which is accessible when the roller-hanger unit is secured to the door and the roller is engaged with the support track so as to permit vertical adjustment of the roller relative to the door when the door is suspended from the support track.

23. An upright interior wall structure disposed in supportive engagement with a floor, comprising:

a plurality of prefabricated upright wall panels disposed in supportive engagement on a floor to subdivide a floor space, wherein first and second ones of said wall panels are spaced apart to define a doorway therebetween;

each said wall panel including a frame assembly having upright edge frame members disposed adjacent opposite side edges thereof, and a horizontally elongate top frame structure extending between and rigidly joined to upper ends of said upright edge frame members wherein said edge frame members carry vertical loading on said top frame structure;

an inverted U-shaped door frame defining a door opening extending transversely therethrough, said door frame including parallel right and left upright side frame members disposed in sidewardly spaced relation in said doorway and defining said door opening therebetween, and an elongate upper frame structure extending horizontally between and rigidly joined to upper ends of the right and left side frame members wherein said side frame members carry vertical loads on said upper frame structure;

said door frame being positioned in said doorway and joined to said first and second walls panel in horizontally aligned relation so that each one of said upright side frame members is positioned adjacent and connected to an adjacent one of said edge frame members of said first and second wall panels, and the top frame structures and the upper frame structure are disposed in adjacent end-to-end relationship;

each of said top and upper frame structures being defined by a main horizontally-elongate top frame member having a generally tubular cross-section and a pair of horizontally-elongate top trim members fixed thereto and protruding upwardly from adjacent opposite sides thereof to define a generally channel-shaped cross-section of the respective frame structure, said top frame members and said top trim members having exposed side faces which define opposite exterior side surfaces of said top and upper frame structures;

a horizontally elongate support track fixed to and extending horizontally along said top and upper frame structures adjacent one of said exterior side surfaces thereof, said support track including an upright first leg which overlies the exterior side surfaces of the aligned upper and top frame structures and is fixedly joined thereto, and a second leg which is joined to said first leg and which is cantilevered horizontally outwardly away from said exterior side surface, said second leg having an upper surface provided with a roller-accommodating guide protruding vertically thereof and extending lengthwise therealong;

the top frame structure of a first wall panel and the upper frame structure having a horizontally elongate reinforcing beam being positioned interiorly of and extending lengthwise along each of the top frame structures and the upper frame structure and being rigidly joined thereto, said reinforcing beams having a combined length which generally corresponds to the length of said support track and being rigidly joined thereto, wherein said reinforcing beams are positioned sidewardly between the top trim members so as to be hidden within said frame structures, and said reinforcing beams being seated on and rigidly joined to the upper and top frame structures associated with the respective said door frame and said first wall panel, said support track and the reinforcing beams being disposed in abutting contact with and disposed on opposite sides of one of the top trim members;

the one-piece support track and the reinforcing beams extending along solely the length of the upper frame structure and the top frame structure and being rigidly joined together by fasteners which extend from the support track through the top trim member to the reinforcing beam such that vertical loads on said support track are carried by said reinforcing beams, and the vertical loads are carried from said reinforcing beams to said upper frame and top frame structures and therefrom respectively to said side frame members and said edge frame members;

a sliding door suspended laterally adjacent one side of said wall panel and suspended vertically from said support track and movable horizontally therealong between a closed position wherein the door overlies and closes off the door opening and an open position wherein the door primarily overlies an exterior side face of said first upright wall panel; and said door mounting on an upper section thereof a pair of roller-hanger units each having a roller cantilevered in rearward relationship relative to the door and positioned above the second leg of the support track so that the roller is engaged with the roller-accommodating guide, said roller-hanger units being located exteriorly of said top and upper frame structures on one of the exterior sides thereof wherein the vertical loading created by the door is transmitted solely to the top and upper frame structures and the reinforcing beams associated with the respective door frame and first upright panel by the rigid connection of said support track to said reinforcing beams and is then transmitted vertically downwardly to the floor through the side frame members and edge frame members.

24. An interior wall according to claim 23, wherein the support track as mounted on the top and upper frame structures has a cover overlying said fasteners on a portion of said fist leg and is free of shrouds or other enclosures such that said second leg is exposed.

25. An interior wall according to claim 24, wherein said first leg has an upper leg portion thereof formed with fastener bores through which said fasteners extend to join said support track to said upper and top frame structures, said cover being removably connected to said upper leg portion to enclose said fasteners and define an exposed surface which hides said fasteners.

26. A wall structure according to claim 23, wherein the roller-hanger unit includes a vertical adjustment structure which permits the position of the roller to be vertically adjusted relative to the door when the roller-hanger unit is mounted to the door and the roller is engaged with the second leg of the support track.

* * * * *